US011152149B2

(12) United States Patent
Kido

(10) Patent No.: US 11,152,149 B2
(45) Date of Patent: Oct. 19, 2021

(54) ELECTRONIC COMPONENT

(71) Applicant: Murata Manufacturing Co., Ltd., Kyoto-fu (JP)

(72) Inventor: Tomohiro Kido, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 16/928,905

(22) Filed: Jul. 14, 2020

(65) Prior Publication Data

US 2020/0343039 A1 Oct. 29, 2020

Related U.S. Application Data

(62) Division of application No. 16/591,269, filed on Oct. 2, 2019, now Pat. No. 10,957,478, which is a division (Continued)

(30) Foreign Application Priority Data

Mar. 4, 2016 (JP) ..... 2016-041728

(51) Int. Cl.
*H01F 5/00* (2006.01)
*H01F 27/29* (2006.01)
(Continued)

(52) U.S. Cl.
CPC ..... *H01F 27/292* (2013.01); *H01F 17/0013* (2013.01); *H01F 27/2804* (2013.01); *H01F 2027/2809* (2013.01)

(58) Field of Classification Search
USPC ..... 336/200
See application file for complete search history.

(56) References Cited

U.S. PATENT DOCUMENTS 6,218,925 B1 * 4/2001 Iwao ..... H01F 17/0013 336/200
8,201,318 B2 * 6/2012 Yamano ..... H01F 27/292 29/602.1
(Continued)

FOREIGN PATENT DOCUMENTS

CN 103219129 A 7/2013
JP 2013-153009 A 8/2013
(Continued)

OTHER PUBLICATIONS

An Office Action; "Notification of Reasons for Refusal," Mailed by the Japanese Patent Office dated Oct. 9, 2018, which corresponds to Japanese Patent Application No. 2016-041728 and is related to U.S. Appl. No. 15/432,197; with English language translation.

*Primary Examiner* — Ronald Hinson
(74) *Attorney, Agent, or Firm* — Studebaker & Brackett PC

(57) ABSTRACT

An electronic component includes insulator layers having first and second sides respectively extending in first and second directions from a first point, and outer conductor layers extends in the first and second direction from the first point. Each of the outer conductor layers has second and third points. One of the outer conductor layers has a fixing portion inside a region having a third side connecting the second and third points, and fourth and fifth sides respectively extending from the second point in the reverse first direction and from the third point in the reverse second direction.

21 Claims, 17 Drawing Sheets

Related U.S. Application Data of application No. 15/432,197, filed on Feb. 14, 2017, now Pat. No. 10,475,570.

(51) Int. Cl.
*H01F 17/00* (2006.01)
*H01F 27/28* (2006.01)

(56) References Cited

U.S. PATENT DOCUMENTS

| | | | | |
|---|---|---|---|---|
| 8,810,351 | B2 * | 8/2014 | Jeong | H01F 27/292 336/200 |
| 2008/0257488 | A1 * | 10/2008 | Yamano | H01F 41/041 156/272.4 |
| 2013/0187744 | A1 * | 7/2013 | Seko | H01F 17/0013 336/200 |
| 2015/0287516 | A1 * | 10/2015 | Park | H01F 17/0013 336/192 |
| 2016/0141102 | A1 * | 5/2016 | Tseng | H01F 27/292 336/192 |
| 2017/0207018 | A1 * | 7/2017 | Jung | H01F 41/041 |

FOREIGN PATENT DOCUMENTS

| | | | |
|---|---|---|---|
| JP | 2014-039036 | A | 2/2014 |
| WO | 2012/086397 | A1 | 6/2012 |

* cited by examiner

ELECTRONIC COMPONENT

CROSS REFERENCE TO RELATED APPLICATIONS

This application is a Divisional of U.S. application Ser. No. 16/591,269 filed Oct. 2, 2019, which is a Divisional of U.S. application Ser. No. 15/432,197 filed Feb. 14, 2017, which claims benefit of priority to Japanese Patent Application 2016-041728 filed Mar. 4, 2016, the entire content of which is incorporated herein by reference.

TECHNICAL FIELD

The present disclosure relates to an electronic component, and more specifically to an electronic component including an inductor.

BACKGROUND

Existing examples of disclosures related to electronic components include the inductor described in Japanese Unexamined Patent Application Publication No. 2014-39036. FIG. 11 is an external perspective view of an inductor 500 described in Japanese Unexamined Patent Application Publication No. 2014-39036. Hereafter, the stacking direction of layers forming the inductor 500 is defined as the front-back direction. With the inductor 500 viewed from the front, the direction in which the long side of the inductor 500 extends is defined as the left-right direction, and the direction in which the short side of the inductor 500 extends is defined as the up-down direction.

The inductor 500 includes outer electrode portions 502 and 504, a base substrate 510, pattern layers 512*a* to 512*c*, and a coil pattern portion (not illustrated). The pattern layers 512*a* to 512*c* are stacked over the base substrate 510 in this order from the back side toward the front. The outer electrode portion 502 extends through substantially the left half of the lower long side of each of the pattern layers 512*a* to 512*c* in the front-back direction. When viewed from the front, the outer electrode portion 502 is substantially in the form of a strip extending in the left-right direction. The outer electrode portion 504 extends through substantially the right half of the lower long side of each of the pattern layers 512*a* to 512*c* in the front-back direction. When viewed from the front, the outer electrode portion 504 is substantially in the form of a strip extending in the left-right direction. It is to be noted, however, that a space is provided between the outer electrode portion 502 and the outer electrode portion 504 to avoid contact between the outer electrode portion 502 and the outer electrode portion 504. The coil pattern portion (not illustrated) is disposed on each of the pattern layers 512*a* and 512*b*, and connected to each of the outer electrode portions 502 and 504. When the inductor 500 configured as described above is mounted onto a circuit board, the lower face of the inductor 500 becomes the mounting face that faces the circuit board. The outer electrode portions 502 and 504 and the coil pattern portion of the inductor 500 can be formed simultaneously, rather than being formed separately, thus improving manufacturing efficiency. Further, the outer electrode portions 502 and 504 are formed mainly at the lower face of the inductor 500, thus allowing for reduced mounting area.

SUMMARY

For the inductor 500 configured as described above, demands exist for firmer fixing of the inductor 500 to the circuit board. To meet such demands, for example, the outer electrode portions 502 and 504 are often formed to have a substantially L-shaped configuration when viewed from the front. Thus, when the inductor 500 is mounted onto the circuit board, the solder wets onto the right and left faces of the inductor 500, forming a fillet. This provides firm fixing of the inductor 500 to the circuit board.

The circuit board on which the inductor 500 is mounted often experiences deformation due to impact, temperature changes, or other causes. In particular, the outer electrode portions 502 and 504 are components used for the purpose of reducing the size of the inductor 500, and components such as the inductor 500 and the outer electrode portions 502 and 504 are often manufactured in smaller sizes than heretofore. In such cases, if the attachment between the outer electrode portions 502 and 504, and the base substrate 510 and the pattern layers 512*a* to 512*c* decreases, and the above-mentioned deformation occurs in the circuit board, this may cause the outer electrode portions 502 and 504 to become dislodged from the inductor 500 as the outer electrode portions 502 and 504 are pulled by the circuit board to which the outer electrode portions 502 and 504 are more firmly fixed.

Accordingly, it is an object of the present disclosure to provide an electronic component that makes it possible to reduce dislodging of outer electrodes from a multilayer body.

According to one embodiment of the present disclosure, there is provided an electronic component including a multilayer body including a plurality of insulator layers stacked in the stacking direction, the insulator layers each having a substantially rectangular principal face that has a first side and a second side, the first side on a line extending in a first direction from a first point, the second side on a line extending in a second direction from the first point, the second direction substantially perpendicular to the first direction, an outer electrode including a plurality of outer conductor layers that, when viewed in the stacking direction, extends along the first direction and the second direction from the first point, the outer conductor layers being exposed from the multilayer body, an inductor having a substantially helical configuration where a central axis extends in the stacking direction, the inductor including a plurality of inductor conductor layers disposed on the different insulator layers, and a lead conductor layer that connects one of the outer conductor layers with one of the inductor conductor layers. Each of the outer conductor layers has a first portion located farthest from the first point along the first direction in an uninterruptedly extending part of the outer conductor layer from the first point along the first direction. The first portion has a second point located farthest from the first point along the second direction. Each of the outer conductor layers has a second portion located farthest from the first point along the second direction in an uninterruptedly extending part of the outer conductor layer from the first point along the second direction. The second portion has a third point located farthest from the first point along the first direction. The outer conductor layers include a first outer conductor layer. The first outer conductor layer has a fixing portion different from the lead conductor layer, the fixing portion being located inside a first region of a substantially triangular shape having a third side, a fourth side, and a fifth side, the third side connecting the second point with the third point, the fourth side extending from the second point in a reverse direction of the first direction, the fifth side extending from the third point in a reverse direction of the second direction.

Embodiments of the present disclosure make it possible to reduce dislodging of outer electrodes from a multilayer body.

Other features, elements, characteristics and advantages of the present disclosure will become more apparent from the following detailed description of the present disclosure with reference to the attached drawings.

DETAILED DESCRIPTION

An electronic component according to embodiments of the present disclosure will be described below.

Configuration of Electronic Component

Figure 1:
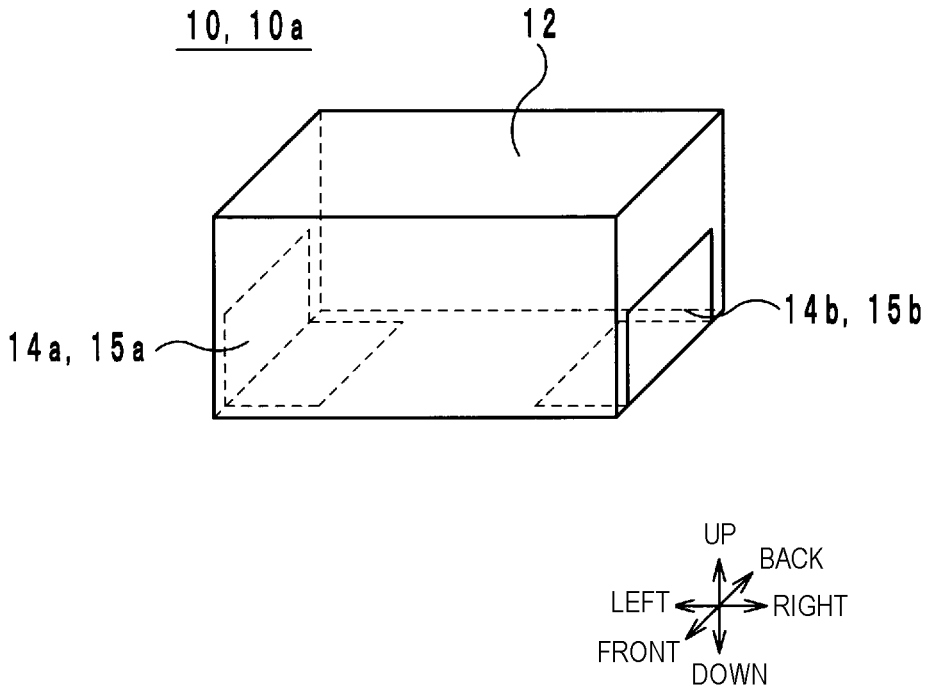
FIG. 1 is an external perspective view of an electronic component.
Figure 2:
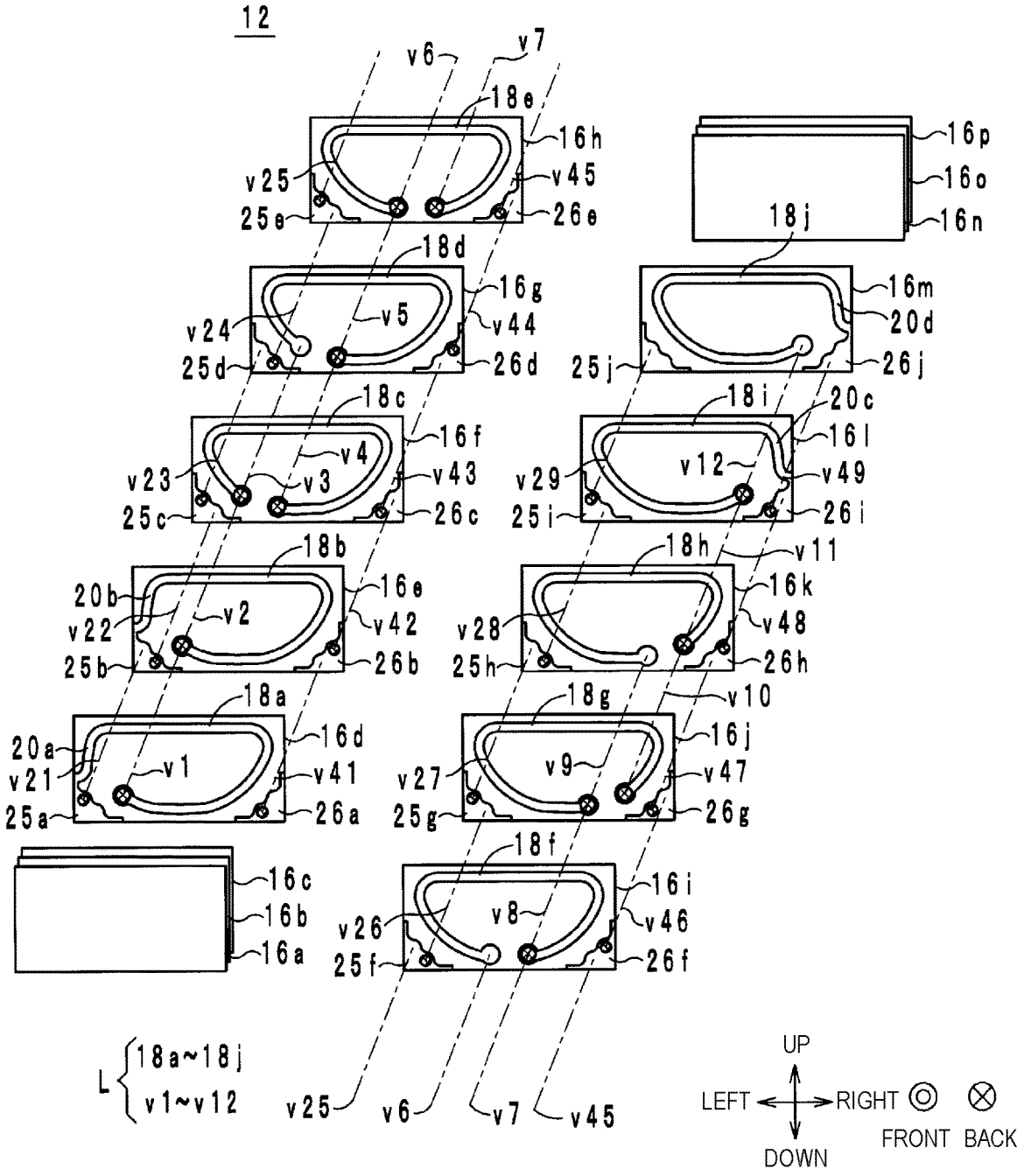
FIG. 2 is an exploded perspective view of a multilayer body of the electronic component illustrated in FIG. 1.
Figure 3A:
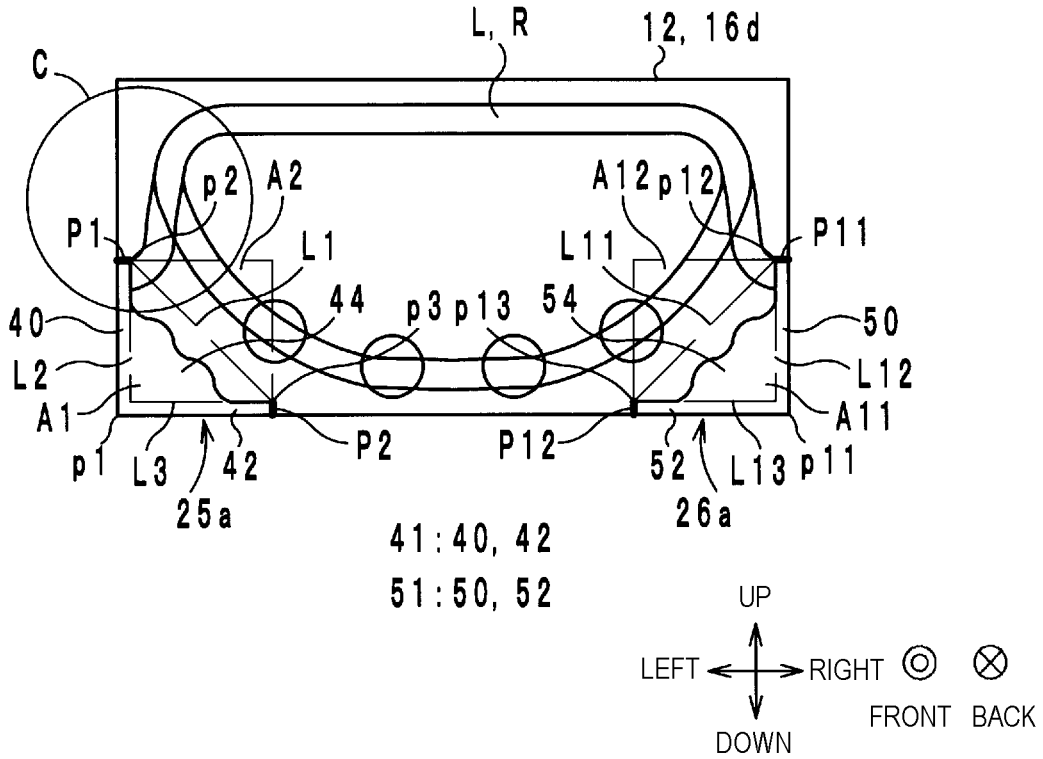
FIG. 3A is a front see-through view of a multilayer body.
Figure 3B:
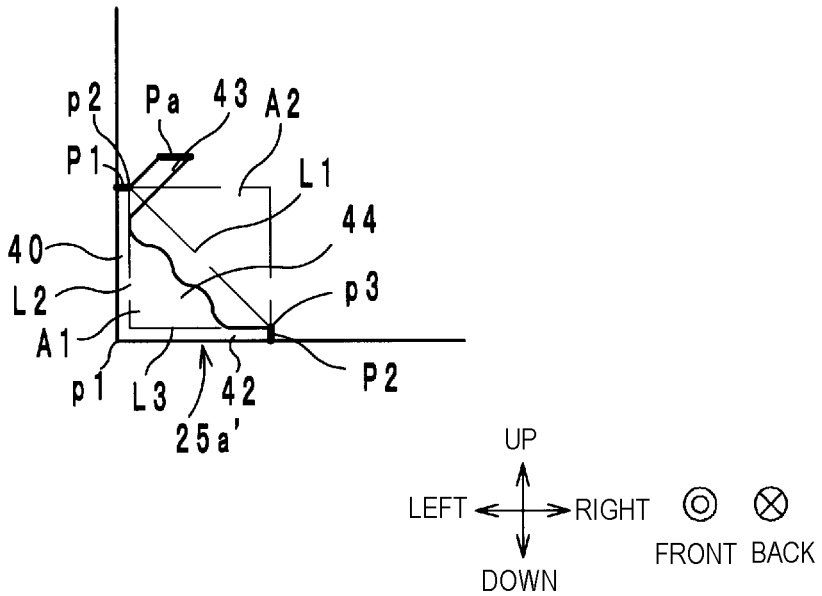
FIG. 3B illustrates a portion P1.
Figure 3C:
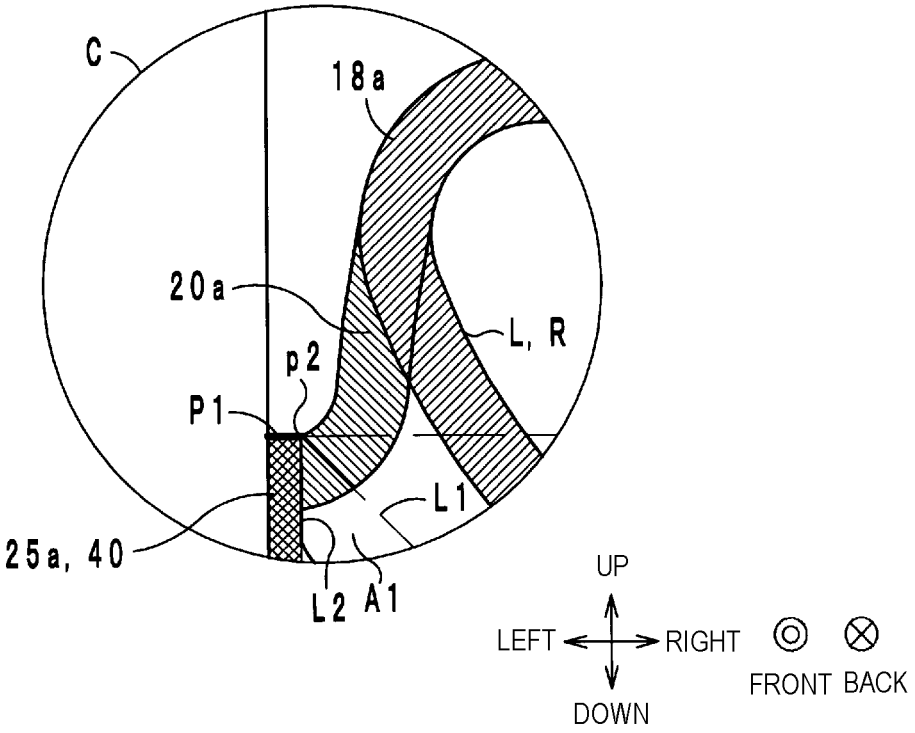
FIG. 3C is an enlarged view of a portion C illustrated in FIG. 3A.

An electronic component according to an embodiment will be described below with reference to the drawings. FIG. 1 is an external perspective view of an electronic component 10 or 10*a*. FIG. 2 is an exploded perspective view of a multilayer body 12 of the electronic component 10 illustrated in FIG. 1. FIG. 3A is a front see-through view of the multilayer body 12. FIG. 3B illustrates a portion P1. FIG. 3C is an enlarged view of the portion C illustrated in FIG. 3A. Hereafter, the stacking direction of layers forming the electronic component 10 is defined as the front-back direction. With the electronic component 10 viewed from the front, the direction in which the long side of the electronic component 10 extends is defined as the left-right direction (an example of a second direction), and the direction in which the short side of the electronic component 10 extends is defined as the up-down direction (an example of a first direction). The up-down direction, the left-right direction, and the front-back direction are substantially orthogonal (perpendicular) to each other. The terms up-down direction, left-right direction, and front-back direction are used for illustrative purposes. Thus, when the electronic component 10 is in use, the up-down, left-right, and front-back directions of the electronic component 10 may not necessarily coincide with the actual up-down, left-right, and front-back directions.

As illustrated in FIGS. 1 and 2, the electronic component 10 includes the multilayer body 12, outer electrodes 14*a* and 14*b*, lead conductor layers 20*a* to 20*d*, and an inductor L. Thus, the lead conductor layers 20*a* to 20*d* do not constitute a part of the inductor L.

As illustrated in FIG. 2, the multilayer body 12 includes a stack of substantially rectangular insulator layers 16*a* to 16*p* (an example of a plurality of insulator layers) arranged in this order from the front toward the back of the multilayer body 12 to form a substantially rectangular parallelepiped shape.

As illustrated in FIG. 2, the insulator layers 16*a* to 16*p* each have a principal face of a substantially rectangular shape with two short sides and two long sides. Each of the insulator layers 16*a* to 16*p* is formed of, for example, an insulating material containing borosilicate glass as a main component. The term substantially rectangular shape as used herein includes a substantially square shape, or a substantially rectangular shape with a missing part. The two short sides (the left short side is an example of a first side) of the insulator layers 16*a* to 16*p* extend in the up-down direction, and the two long sides (the lower long side is an example of a second side) of the insulator layers 16*a* to 16*p* extend in the left-right direction. Hereinafter, the face at the front of the insulator layers 16*a* to 16*p* will be referred to as front face, and the face at the back of the insulator layers 16*a* to 16*p* will be referred to as back face.

The left face (an example of a first face) of the multilayer body 12 is formed by a succession of the left short sides of the insulator layers 16*a* to 16*p*. The right face of the multilayer body 12 is formed by a succession of the right short sides of the insulator layers 16*a* to 16*p*. The upper face of the multilayer body 12 is formed by a succession of the upper long sides of the insulator layers 16*a* to 16*p*. The lower face (an example of a second face) of the multilayer body 12 is formed by a succession of the lower long sides of the insulator layers 16*a* to 16*p*. The lower face of the multilayer body 12 is the mounting face of the multilayer body 12. The mounting face refers to the face of the multilayer body 12 that faces the circuit board when the electronic component 10 is mounted onto the circuit board.

The outer electrode 14*a* (an example of an outer electrode) includes a plated layer 15*a* (an example of an outer conductor film), outer conductor layers 25*a* to 25*j*, and via-hole conductors v21 to v29.

As illustrated in FIG. 2, the outer conductor layers 25*a* to 25*j* are respectively disposed on the front faces of the insulator layers 16*d* to 16*m*. Thus, each insulator layer is present between outer conductor layers that are adjacent to each other in the front-back direction. That is, the insulator layers 16*d* to 16*m* (an example of at least one of insulator layers) and the outer conductor layers 25*a* to 25*j* (an example of a plurality of the outer conductor layers) are alternately arranged in the front-back direction. The outer conductor layers 25*a* to 25*j* are formed in the same shape from the same material. Accordingly, although the outer conductor layer 25*a* will be described below by way of example, the following description equally applies to the outer conductor layers 25*b* to 25*j*. As illustrated in FIG. 3A, hereinafter, the lower left corner of the insulator layer 16*d* where the left short side and the lower long side intersect will be referred to as a corner p1 (an example of a first point), and the lower right corner of the insulator layer 16*d* where the right short side and the lower long side intersect will be referred to as a corner p11.

The outer conductor layer 25*a* (an example of a first outer conductor layer) includes an L-shaped portion 41, and a fixing portion 44. The L-shaped portion 41 has strip conductor layers 40 and 42, and is substantially L-shaped. The strip conductor layer 40 has a substantially rectangular shape that extends upward from the corner p1 along the left short side. The strip conductor layer 42 has a substantially rectangular shape that extends rightward from the corner p1 along the lower long side. The lower end of the strip conductor layer 40 and the left end of the strip conductor layer 42 overlap at and near the corner p1. Thus, the outer conductor layer 25*a* is located at the corner p1 of the insulator layer 16*d*, and exposed from the multilayer body 12 at the left and lower faces of the multilayer body 12. That is, as the strip conductor layer 40 is sandwiched by the insulator layer 16*c* and the insulator layer 16*d*, the strip conductor layer 40 becomes exposed in a streak-like manner at the left face of the multilayer body 12 so as to extend upward from the corner p1 of the multilayer body 12. Likewise, as the strip conductor layer 42 is sandwiched by the insulator layer 16*c* and the insulator layer 16*d*, the strip conductor layer 42 becomes exposed in a streak-like manner at the lower face of the multilayer body 12 so as to extend rightward from the corner p1 of the multilayer body 12.

In the portion of the outer conductor layer 25*a* where the conductor layer extends upward uninterruptedly from the lower long side of the insulator layer 16*d*, the portion located farthest upward (an example of one side of the first direction) from the corner p1 is defined as a portion P1 (an example of a first portion). The portion P1 corresponds to the upper short side of the strip conductor layer 40. Determination of the portion P1 will be described below in detail with reference to FIG. 3B.

FIG. 3B illustrates an outer conductor layer 25*a*' that further includes a protrusion conductor layer 43. The outer conductor layer 25*a*' illustrated in FIG. 3B represents a modification of the outer conductor layer 25*a* illustrated in FIG. 2. The protrusion conductor layer 43 extends upward to the right from the strip conductor layer 40. An upper end Pa of the protrusion conductor layer 43 is located above the upper short side of the strip conductor layer 40. However, the portion P1 of the outer conductor layer 25*a*' illustrated in FIG. 3B is not the upper end Pa.

In the portion where the conductor layer extends upward uninterruptedly from the lower long side of the insulator layer 16*d*, the portion P1 is the portion located farthest upward from the corner p1. The portion where the conductor layer extends upward uninterruptedly from the lower long side of the insulator layer 16*d* means a portion where the conductor layer continues to exist without a break as the conductor layer extends upward from the lower long side of the insulator layer 16*d*. An area where no conductor layer is provided exists under the protrusion conductor layer 43. Thus, the protrusion conductor layer 43 does not correspond to the portion where the conductor layer extends upward uninterruptedly from the lower long side of the insulator layer 16*d*. In the strip conductor layer 40, the conductor layer extends uninterruptedly from the lower side of the insulator layer 16*d*. Thus, the strip conductor layer 40 corresponds to the portion where the conductor layer extends upward uninterruptedly from the lower long side of the insulator layer 16*d*. Thus, in the outer conductor layer 25*a*' illustrated in FIG. 3B, the portion P1 is the upper short side of the strip conductor layer 40.

Further, the position on the portion P1 located farthest to the right from the corner p1 is defined as a point p2 (an example of a second point). Further, in the portion of the outer conductor layer 25*a* where the conductor layer extends rightward uninterruptedly from the left short side of the insulator layer 16*d*, the portion located farthest to the right (an example of one side of the second direction) from the corner p1 is defined as a portion P2 (an example of a second portion). The portion P2 corresponds to the right short side of the strip conductor layer 42. Further, the position on the portion P2 located farthest upward from the corner p1 is defined as a point p3 (an example of a third point).

The substantially straight line connecting the point p2 with the point p3 is defined as a side L1 (an example of a third side). The substantially straight line that extends downward (an example of the other side of the first direction) from the point p2 is defined as a side L2 (an example of a fourth side). The substantially straight line that extends leftward (an example of the other side of the second direction) from the point p3 is defined as a side L3 (an example of a fifth side). The substantially triangular region having the sides L1 to L3 is defined as a region A1 (an example of a first region). That is, the region A1 has the shape of a substantially right-angled triangle having the side L1 as the hypotenuse, and the sides L2 and L3 as the adjacent sides. In this embodiment, the region A1 is a region bounded by the L-shaped portion 41 and the side L1. It is to be noted, however, that the region A1 represents the area inside the region bounded by the outer edge of the L-shaped portion 41 and the side L1, and does not include the outer edge of the L-shaped portion 41 and the side L1. Further, the substantially rectangular (square in this embodiment) region with its diagonal coinciding with the side L1 is defined as a region A2 (an example of a second region).

The fixing portion 44 is located inside the region A1, and has the shape of a substantially right-angled triangle. More specifically, the two adjacent sides of the fixing portion 44 are in contact with the sides L2 and L3 (that is, the right long side of the strip conductor layer 40 and the upper long side of the strip conductor layer 42). The hypotenuse of the fixing portion 44 is located to the lower left from the side L1, and is substantially parallel to the side L1. Thus, the fixing portion 44 (the outer conductor layer 25*a*) does not extend out of the region A2, nor does the fixing portion 44 cross the side L1 to extend out of the region A1. The hypotenuse of the fixing portion 44 has two small protrusions. This provides the hypotenuse of the fixing portion 44 with irregularities. The two protrusions are provided to allow for connection with via-hole conductors described later. The outer conductor layer 25*a* configured as described above is made of, for example, an electrically conductive material including Ag as a main component. The strip conductor layers 40 and 42 (the L-shaped portion 41), and the fixing portion 44 are all subdivisions used for illustrative purposes. It is to be understood that no physical boundary lines such as steps exist at the boundary between these portions of the outer conductor layer 25*a*. That is, the outer conductor layer 25*a* is made up of a single conductor layer. Further, the expression "inside the region A1" refers to the area that lies inward of the sides L1 to L3, and does not include the area that lies on the sides L1 to L3.

The plated layer 15*a* covers the portion of the multilayer body 12 where the outer conductor layers 25*a* to 25*j* are exposed from the multilayer body 12 at the left and lower faces of the multilayer body 12. The plated layer 15*a* has a substantially rectangular shape when viewed from the left, and has a substantially rectangular shape when viewed from below. The plated layer 15*a* configured as described above may be prepared by applying Sn plating onto Ni plating, for example. Alternatively, the plated layer 15*a* may be made of, for example, a material with properties such as low electrical resistance, high solder resistance, and high solder wettability, such as Sn, Ni, Cu, or Au, or an alloy thereof.

The via-hole conductors v21 to v29 (an example of interlayer connection conductors) respectively extend through the insulator layers 16*d* to 16*l* in the front-back direction. Each of the via-hole conductors v21 to v29 connects the fixing portions 44 of two outer conductor layers that are adjacent to each other in the front-back direction. The via-hole conductor v21 connects the fixing portion 44 of the outer conductor layer 25*a* with the fixing portion 44 of the outer conductor layer 25*b*. The via-hole conductor v22 connects the fixing portion 44 of the outer conductor layer 25*b* with the fixing portion 44 of the outer conductor layer 25*c*. The via-hole conductor v23 connects the fixing portion 44 of the outer conductor layer 25*c* with the fixing portion 44 of the outer conductor layer 25*d*. The via-hole conductor v24 connects the fixing portion 44 of the outer conductor layer 25*d* with the fixing portion 44 of the outer conductor layer 25*e*. The via-hole conductor v25 connects the fixing portion 44 of the outer conductor layer 25*e* with the fixing portion 44 of the outer conductor layer 25*f*. The via-hole conductor v26 connects the fixing portion 44 of the outer conductor layer 25*f* with the fixing portion 44 of the outer conductor layer 25*g*. The via-hole conductor v27 connects the fixing portion 44 of the outer conductor layer 25*g* with the fixing portion 44 of the outer conductor layer 25*h*. The via-hole conductor v28 connects the fixing portion 44 of the outer conductor layer 25*h* with the fixing portion 44 of the outer conductor layer 25*i*. The via-hole conductor v29 connects the fixing portion 44 of the outer conductor layer 25*i* with the fixing portion 44 of the outer conductor layer 25*j*.

The via-hole conductors v21, v23, v25, v27, and v29 overlap when viewed from the front, and the via-hole conductors v22, v24, v26, and v28 overlap when viewed from the front. When viewed from the front, the via-hole conductors v21, v23, v25, v27, and v29 are respectively located to the upper left from the via-hole conductors v22, v24, v26, and v28. Thus, the via-hole conductors v21 to v29 are arranged such that their positions are alternately switched from the front side toward the back. Thus, each two of the via-hole conductors v21 to v29 that are adjacent to each other in the front-back direction do not overlap when viewed from the front.

The positional relationship between two via-hole conductors that are adjacent to each other in the front-back direction will be described in more detail with the via-hole conductors v21 and v22 taken as an example. The outer conductor layer 25*a* (an example of a second outer conductor layer), the outer conductor layer 25*b* (an example of a third outer conductor layer), and the outer conductor layer 25*c* (an example of a fourth outer conductor layer) are arranged in the stated order from the front side toward the back. The via-hole conductor v21 (an example of a first interlayer connection conductor) connects the outer conductor layer 25*a* with the outer conductor layer 25*b*. The via-hole conductor v22 (an example of a second interlayer connection conductor) connects the outer conductor layer 25*b* with the outer conductor layer 25*c*. The via-hole conductor v21 and the via-hole conductor v22 do not overlap when viewed from the front. The positional relationship that holds between the via-hole conductor v21 and the via-hole conductor v22 equally holds between the via-hole conductor v22 and the via-hole conductor v23, between the via-hole conductor v23 and the via-hole conductor v24, between the via-hole conductor v24 and the via-hole conductor v25, between the via-hole conductor v25 and the via-hole conductor v26, between the via-hole conductor v26 and the via-hole conductor v27, between the via-hole conductor v27 and the via-hole conductor v28, and between the via-hole conductor v28 and the via-hole conductor v29.

The via-hole conductors v21 to v29 are not exposed from the multilayer body 12 at the left and lower faces of the multilayer body 12. The via-hole conductors v21 to v29 configured as described above are each made of, for example, an electrically conductive material having Ag as a main component.

Via-hole conductors refer to conductors located within through-holes formed in the corresponding insulator layers. Accordingly, via-hole conductors do not include a conductor located forward of the front face of an insulator layer and a conductor located backward of the back face of the insulator layer. For example, for the insulator layer 16*d*, a conductor located forward of the front face of the insulator layer 16*d* is not the via-hole conductor v21 but the outer conductor layer 25*a*.

The outer electrode 14*b* includes a plated layer 15*b*, outer conductor layers 26*a* to 26*j*, and via-hole conductors v41 to v49.

As illustrated in FIG. 2, the outer conductor layers 26*a* to 26*j* are respectively disposed on the front faces of the insulator layers 16*d* to 16*m*. Each insulator layer is disposed between outer conductor layers that are adjacent to each other in the front-back direction. That is, the insulator layers 16*d* to 16*m* and the outer conductor layers 26*a* to 26*j* are alternately arranged in the front-back direction. The outer conductor layers 26*a* to 26*j* are formed in the same shape from the same material. Accordingly, although the outer conductor layer 26*a* will be described below by way of example, the following description equally applies to the outer conductor layers 26*b* to 26*j*.

The outer conductor layer 26*a* includes an L-shaped portion 51, and a fixing portion 54. The L-shaped portion 51 has strip conductor layers 50 and 52, and is substantially L-shaped. The strip conductor layer 50 has a substantially rectangular shape that extends upward from the corner p11 along the right short side. The strip conductor layer 52 has a substantially rectangular shape that extends leftward from the corner p11 along the lower long side. The lower end of the strip conductor layer 50 and the right end of the strip conductor layer 52 overlap at and near the corner p11. Thus, the outer conductor layer 26*a* is located at the corner p11 of the insulator layer 16*d*, and exposed from the multilayer body 12 at the right and lower faces of the multilayer body 12. That is, as the strip conductor layer 50 is sandwiched by the insulator layer 16*c* and the insulator layer 16*d*, the strip conductor layer 50 becomes exposed in a streak-like manner at the right face of the multilayer body 12 so as to extend upward from the corner p11 of the multilayer body 12. Likewise, as the strip conductor layer 52 is sandwiched by the insulator layer 16*c* and the insulator layer 16*d*, the strip conductor layer 52 becomes exposed in a streak-like manner at the lower face of the multilayer body 12 so as to extend leftward from the corner p11 of the multilayer body 12.

In the portion of the outer conductor layer 26*a* where the conductor layer extends upward uninterruptedly from the lower long side of the insulator layer 16*d*, the portion located farthest upward from the corner p11 is defined as a portion P11. The portion P11 corresponds to the upper short side of the strip conductor layer 50. Further, the position on the portion P11 located farthest to the left from the corner p11 is defined as a point p12. Further, in the portion of the outer conductor layer 26*a* where the conductor layer extends leftward uninterruptedly from the right short side of the insulator layer 16*d*, the portion located farthest to the left from the corner p11 is defined as a portion P12. The portion P12 corresponds to the left short side of the strip conductor layer 52. Further, the position on the portion P12 located farthest upward from the corner p11 is defined as a point p13.

The substantially straight line connecting the point p12 with the point p13 is defined as a side L11. The substantially straight line that extends downward from the point p12 is defined as a side L12. The substantially straight line that extends rightward from the point p13 is defined as a side L13. The substantially triangular region having the sides L11 to L13 is defined as a region A11. That is, the region A11 has the shape of a substantially right-angled triangle having the side L11 as the hypotenuse and the sides L12 and L13 as the adjacent sides. In this embodiment, the region A11 is a region bounded by the L-shaped portion 51 and the side L11. It is to be noted, however, that the region A11 represents the area inside the region bounded by the outer edge of the L-shaped portion 51 and the side L11, and does not include the outer edge of the L-shaped portion 51 and the side L11. Further, the substantially rectangular (square in this embodiment) region with its diagonal coinciding with the side L11 is defined as a region A12.

The fixing portion 54 is located inside the region A11, and has the shape of a substantially right-angled triangle. More specifically, the two adjacent sides of the fixing portion 54 are in contact with the sides L12 and L13 (that is, the left long side of the strip conductor layer 50 and the upper long side of the strip conductor layer 52). The hypotenuse of the fixing portion 54 is located to the lower right from the side L11, and is substantially parallel to the side L11. Thus, the fixing portion 54 (the outer conductor layer 26*a*) does not cross the side L11 to extend out of the region A11. The hypotenuse of the fixing portion 54 has two small protrusions. This provides the hypotenuse of the fixing portion 54 with irregularities. The two protrusions are provided to allow for connection with via-hole conductors described later. The outer conductor layer 26*a* configured as described above is made of, for example, an electrically conductive material including Ag as a main component. The strip conductor layers 50 and 52 (the L-shaped portion 51), and the fixing portion 54 are all subdivisions used for illustrative purposes. It is to be understood that no physical boundary lines such as steps exist at the boundary between these portions of the outer conductor layer 26*a*. That is, the outer conductor layer 26*a* is made up of a single conductor layer. Further, the expression "inside the region A11" refers to the area that lies inward of the sides L11 to L13, and does not include the area that lies on the sides L11 to L13.

The plated layer 15*b* covers the portion of the multilayer body 12 where the outer conductor layers 26*a* to 26*j* are exposed from the multilayer body 12 at the right and lower faces of the multilayer body 12. The plated layer 15*b* has a substantially rectangular shape when viewed from the right, and has a substantially rectangular shape when viewed from below. The plated layer 15*b* configured as described above may be prepared by applying Sn plating onto Ni plating, for example. Alternatively, the plated layer 15*b* may be made of, for example, a material with properties such as low electrical resistance, high solder resistance, and high solder wettability, such as Sn, Ni, Cu, or Au, or an alloy thereof.

The via-hole conductors v41 to v49 respectively extend through the insulator layers 16*d* to 16*l* in the front-back direction. Each of the via-hole conductors v41 to v49 connects the fixing portions 54 of two outer conductor layers that are adjacent to each other in the front-back direction. The via-hole conductor v41 connects the fixing portion 54 of the outer conductor layer 26*a* with the fixing portion 54 of the outer conductor layer 26*b*. The via-hole conductor v42 connects the fixing portion 54 of the outer conductor layer 26*b* with the fixing portion 54 of the outer conductor layer 26*c*. The via-hole conductor v43 connects the fixing portion 54 of the outer conductor layer 26*c* with the fixing portion 54 of the outer conductor layer 26*d*. The via-hole conductor v44 connects the fixing portion 54 of the outer conductor layer 26*d* with the fixing portion 54 of the outer conductor layer 26*e*. The via-hole conductor v45 connects the fixing portion 54 of the outer conductor layer 26*e* with the fixing portion 54 of the outer conductor layer 26*f*. The via-hole conductor v46 connects the fixing portion 54 of the outer conductor layer 26*f* with the fixing portion 54 of the outer conductor layer 26*g*. The via-hole conductor v47 connects the fixing portion 54 of the outer conductor layer 26*g* with the fixing portion 54 of the outer conductor layer 26*h*. The via-hole conductor v48 connects the fixing portion 54 of the outer conductor layer 26*h* with the fixing portion 54 of the outer conductor layer 26*i*. The via-hole conductor v49 connects the fixing portion 54 of the outer conductor layer 26*i* with the fixing portion 54 of the outer conductor layer 26*j*.

The via-hole conductors v41, v43, v45, v47, and v49 overlap when viewed from the front. The via-hole conductors v42, v44, v46, and v48 overlap when viewed from the front. When viewed from the front, the via-hole conductors v41, v43, v45, v47, and v49 are respectively located to the lower left from the via-hole conductors v42, v44, v46, and v48. Thus, the via-hole conductors v41 to v49 are arranged such that their positions are alternately switched from the front side toward the back. Thus, each two of the via-hole conductors v41 to v49 that are adjacent to each other in the front-back direction do not overlap when viewed from the front.

The positional relationship between two via-hole conductors that are adjacent to each other in the front-back direction will be described in more detail with the via-hole conductors v41 and v42 taken as an example. The outer conductor layer 26*a*, the outer conductor layer 26*b*, and the outer conductor layer 26*c* are arranged in the stated order from the front side toward the back. The via-hole conductor v41 connects the outer conductor layer 26*a* with the outer conductor layer 26*b*. The via-hole conductor v42 connects the outer conductor layer 26*b* with the outer conductor layer 26*c*. The via-hole conductor v41 and the via-hole conductor v42 do not overlap when viewed from the front. The positional relationship that holds between the via-hole conductor v41 and the via-hole conductor v42 equally holds between the via-hole conductor v42 and the via-hole conductor v43, between the via-hole conductor v43 and the via-hole conductor v44, between the via-hole conductor v44 and the via-hole conductor v45, between the via-hole conductor v45 and the via-hole conductor v46, between the via-hole conductor v46 and the via-hole conductor v47, between the via-hole conductor v47 and the via-hole conductor v48, and between the via-hole conductor v48 and the via-hole conductor v49.

The via-hole conductors v41 to v49 are not exposed from the multilayer body 12 at the right and lower faces of the multilayer body 12. The via-hole conductors v41 to v49 configured as described above are each made of, for example, an electrically conductive material having Ag as a main component.

The inductor L is electrically connected to the outer electrodes 14*a* and 14*b*, and includes inductor conductor layers 18*a* to 18*j* (an example of at least one inductor conductor layer) and via-hole conductors v1 to v12. The inductor L is a substantially spiral coil with a central axis extending in the front-back direction. When viewed from the front, the inductor L of the electronic component 10 is substantially in the form of a helix that turns clockwise as the inductor L extends from the front side toward the back.

The inductor conductor layers 18*a* to 18*j* (an example of first inductor conductor layers) are substantially linear conductor layers respectively disposed on the front faces of the insulator layers 16*d* to 16*m* (an example of first insulator layers), with a part of their track R cut away. When viewed from the front, the inductor conductor layers 18*a* to 18*j* overlap each other to define the track R. The inductor conductor layers 18*a* to 18*j* configured as described above are each made of, for example, an electrically conductive material including Ag as a main component. Hereinafter, the upstream end portion of each of the inductor conductor layers 18*a* to 18*j* with respect to the clockwise direction will be referred to as an upstream end, and the downstream end portion of each of the inductor conductor layers 18*a* to 18*j* with respect to the clockwise direction will be referred to as a downstream end.

The via-hole conductor v1 extends through the insulator layer 16*d* in the front-back direction, and connects the downstream end of the inductor conductor layer 18*a* with the downstream end of the inductor conductor layer 18*b*. The via-hole conductor v2 extends through the insulator layer 16*e* in the front-back direction, and connects the downstream end of the inductor conductor layer 18*b* with the upstream end of the inductor conductor layer 18*c*. The via-hole conductor v3 extends through the insulator layer 16*f* in the front-back direction, and connects the upstream end of the inductor conductor layer 18*c* with the upstream end of the inductor conductor layer 18*d*. The via-hole conductor v4 extends through the insulator layer 16*f* in the front-back direction, and connects the downstream end of the inductor conductor layer 18*c* with the downstream end of the inductor conductor layer 18*d*. The via-hole conductor v5 extends through the insulator layer 16*g* in the front-back direction, and connects the downstream end of the inductor conductor layer 18*d* with the upstream end of the inductor conductor layer 18*e*. The via-hole conductor v6 extends through the insulator layer 16*h* in the front-back direction, and connects the upstream end of the inductor conductor layer 18*e* with the upstream end of the inductor conductor layer 18*f*. The via-hole conductor v7 extends through the insulator layer 16*h* in the front-back direction, and connects the downstream end of the inductor conductor layer 18*e* with the downstream end of the inductor conductor layer 18*f*. The via-hole conductor v8 extends through the insulator layer 16*i* in the front-back direction, and connects the downstream end of the inductor conductor layer 18*f* with the upstream end of the inductor conductor layer 18*g*. The via-hole conductor v9 extends through the insulator layer 16*j* in the front-back direction, and connects the upstream end of the inductor conductor layer 18*g* with the upstream end of the inductor conductor layer 18*h*. The via-hole conductor v10 extends through the insulator layer 16*j* in the front-back direction, and connects the downstream end of the inductor conductor layer 18*g* with the downstream end of the inductor conductor layer 18*h*. The via-hole conductor v11 extends through the insulator layer 16*k* in the front-back direction, and connects the downstream end of the inductor conductor layer 18*h* with the upstream end of the inductor conductor layer 18*i*. The via-hole conductor v12 extends through the insulator layer 16*l* in the front-back direction, and connects the upstream end of the inductor conductor layer 18*i* with the upstream end of the inductor conductor layer 18*j*. The via-hole conductors v1 to v12 configured as described above are each made of, for example, an electrically conductive material having Ag as a main component.

As illustrated in FIG. 3A, when viewed from the front, the inductor L configured as described above defines a substantially annular track R having the shape of a substantially isosceles trapezoid with rounded corners. The inductor conductor layers 18*a* to 18*j* are respectively disposed on the insulator layers 16*d* to 16*m* on which the outer conductor layers 25*a* to 25*j* and 26*a* to 26*j* (an example of first outer conductor layers) are provided. When viewed from the front, the inductor conductor layers 18*a* to 18*j* extend into each of the regions A2 and A12. This brings the inductor L (the inductor conductor layers 18*a* to 18*j*) into close proximity to the outer electrodes 14*a* and 14*b*. It is to be noted, however, that the inductor L (the inductor conductor layers 18*a* to 18*j*) does not overlap the outer electrodes 14*a* and 14*b* when viewed from the front.

The lead conductor layer 20*a* is a substantially linear conductor layer disposed on the front face of the insulator layer 16*d*. The lead conductor layer 20*a* connects the upstream end of the inductor conductor layer 18*a* with the outer conductor layer 25*a*. The lead conductor layer 20*b* is a substantially linear conductor layer disposed on the front face of the insulator layer 16*e*. The lead conductor layer 20*b* connects the upstream end of the inductor conductor layer 18*b* with the outer conductor layer 25*b*.

The lead conductor layer 20*c* is a substantially linear conductor layer disposed on the front face of the insulator layer 16*l*. The lead conductor layer 20*c* connects the downstream end of the inductor conductor layer 18*i* with the outer conductor layer 26*i*. The lead conductor layer 20*d* is a substantially linear conductor layer disposed on the front face of the insulator layer 16*m*. The lead conductor layer 20*d* connects the downstream end of the inductor conductor layer 18*j* with the outer conductor layer 26*j*. Thus, the inductor L is electrically connected between the outer electrode 14*a* and the outer electrode 14*b*. The lead conductor layers 20*a* to 20*d* are each made of, for example, an electrically conductive material including Ag as a main component.

Now, the boundary between each of the inductor conductor layers 18*a*, 18*b*, 18*i*, and 18*j*, and the corresponding one of the lead conductor layers 20*a* to 20*d*, and the boundary between each of the outer conductor layers 25*a*, 25*b*, 26*i*, and 26*j*, and the corresponding one of the lead conductor layers 20*a* to 20*d* will be described. The term boundary as used herein refers not to a physical boundary line such as a step but to a virtual line. Although the lead conductor layer 20*a* will be described below by way of example with reference to FIG. 3C, the same description equally applies to the lead conductor layers 20*b* to 20*d*.

The inductor conductor layer 18*a* is located on the track R. Thus, a conductor layer that is not located on the track R is not the inductor conductor layer 18*a*. Accordingly, the boundary between the inductor conductor layer 18*a* and the lead conductor layer 20*a* is the location where the lead conductor layer 20*a* contacts the track R.

A part of the lead conductor layer 20*a* is located inside the region A1. It is to be noted, however, that the lead conductor layer 20*a* is a component different from the outer conductor layer 25*a*. Hence, the portion of the lead conductor layer 20*a* located inside the region A1 is not the fixing portion 44. As illustrated in FIG. 3C, the boundary between the outer conductor layer 25*a* and the lead conductor layer 20*a* is the side L2.

Method for Manufacturing Electronic Component

A method for manufacturing the electronic component 10 according to the embodiment will be described below with reference to FIG. 2.

First, mother insulator layers that are to become the insulator layers 16*m* to 16*p* are formed. Mother insulator layers refer to large insulator layers including the insulator layers 16*m* to 16*p* arranged in matrix form in a connected state. Specifically, for example, a coating of insulating paste including borosilicate glass as a main component is applied onto a carrier film by screen printing, and then the entire insulating paste is exposed to ultraviolet radiation. This causes the insulating paste to solidify, forming a mother insulator layer that is to become the insulator layer 16*p*. The same process is repeated thereafter to also form mother insulator layers that are to become the insulator layers 16*m* to 16*o*.

Next, the inductor conductor layer 18*j*, the lead conductor layer 20*d*, and the outer conductor layers 25*j* and 26*j* are formed by photolithography. Specifically, a coating of photosensitive conductive paste containing Ag as a main metallic component is applied by printing to form a conductive paste layer on the mother insulator layer that is to become the insulator layer 16*m*. Further, the conductive paste layer is irradiated with ultraviolet radiation or other radiations by use of a photomask, and the resulting conductive paste is developed with an alkaline solution or other solutions. As a result, the inductor conductor layer 18*j*, the lead conductor layer 20*d*, and the outer conductor layers 25*j* and 26*j* are formed on the mother insulator layer that is to become the insulator layer 16*m*. If the inductor conductor layer 18*j*, the lead conductor layer 20*d*, and the outer conductor layers 25*j* and 26*j* are made of the same material, these layers may be formed simultaneously.

Next, a mother insulator layer that is to become the insulator layer 16*l* is formed. A coating of insulating paste containing borosilicate glass as a main component is applied by screen printing onto the mother insulator layer that is to become the insulator layer 16*l*, and then the resulting insulating paste is exposed to ultraviolet radiation by use of a photomask that covers the locations where the via-hole conductors v12, v29, and v49 are to be formed. This causes the insulating paste to solidify in areas other than those covered by the photomask. Then, the unsolidified portions of the insulating paste are removed with an alkaline solution or other solutions. As a result, the mother insulator layer that is to become the insulator layer 16*l* is formed, with a through-hole provided at each of the locations where the via-hole conductors v12, v29, and v49 are to be formed.

Next, the inductor conductor layer 18*i*, the lead conductor layer 20*c*, the outer conductor layers 25*i* and 26*i*, and the via-hole conductors v12, v29, and v49 are formed by photolithography. Specifically, a coating of photosensitive conductive paste containing Ag as a main metallic component is applied by printing to form a conductive paste layer on the mother insulator layer that is to become the insulator layer 16*l*. At this time, the through-holes in the mother insulator layer that is to become the insulator layer 16*l* are also filled with the photosensitive conductive paste. Further, the conductive paste layer is irradiated with ultraviolet radiation or other radiations by use of a photomask, and the resulting conductive paste is developed with an alkaline solution or other solutions. As a result, the inductor conductor layer 18*i*, the lead conductor layer 20*c*, the outer conductor layers 25*i* and 26*i*, and the via-hole conductors v12, v29, and v49 are formed on the mother insulator layer that is to become the insulator layer 16*l*. If the inductor conductor layer 18*i*, the lead conductor layer 20*c*, and outer conductor layers 25*i* and 26*i* are made of the same material, these layers may be formed simultaneously.

Thereafter, the same process as that used to form the mother insulator layer that is to become the insulator layer 16*l*, and the same process as that used to form the inductor conductor layer 18*i*, the lead conductor layer 20*c*, the outer conductor layers 25*i* and 26*i*, and the via-hole conductors v12, v29, and v49 are alternately repeated to form mother insulator layers that are to become the insulator layer 16*d* to 16*k*, the inductor conductor layers 18*a* to 18*h*, the lead conductor layers 20*a* and 20*b*, the outer conductor layers 25*a* to 25*h* and 26*a* to 26*h*, and the via-hole conductors v1 to v11, v21 to v28, and v41 to v48.

Next, mother insulator layers that are to become the insulator layers 16*a* to 16*c* are formed. Since the mother insulator layers that are to become the insulator layers 16*a* to 16*c* are formed in the same manner as the mother insulator layer that is to become the insulator layer 16*p*, the description of this process is not repeated. The above-mentioned processes provide a mother multilayer body including a plurality of multilayer bodies 12 arranged in matrix form in a connected state.

Next, the mother multilayer body is cut into a plurality of unfired multilayer bodies 12 by dicing or other methods. In the cutting process of the mother multilayer body, the outer conductor layers 25*a* to 25*j* and 26*a* to 26*j* are exposed from each of the multilayer bodies 12 at the cut faces formed by the cutting process. At this time, the mother multilayer body is cut by taking shrinkage of each multilayer body 12, which occurs in the firing process described later, into account.

Next, each of the unfired multilayer bodies 12 is fired under predetermined conditions to obtain the multilayer body 12. Further, the multilayer body 12 is subjected to barrel finishing.

Lastly, the areas where the outer conductor layers 25*a* to 25*j* and 26*a* to 26*j* are exposed from the multilayer body 12 are applied with Ni plating at a thickness of not less than about 2 μm and not more than about 10 μm and Sn plating at a thickness of not less than about 2 μm and not more than about 10 μm. The above processes complete the electronic component 10. The completed electronic component 10 has a size of, for example, about 0.4 mm×0.2 mm×0.2 mm.

Advantages

The electronic component 10 configured as described above makes it possible to reduce dislodging of the outer electrode 14*a* from the multilayer body 12. This is described below with an electronic component according to a first comparative example taken as an example. The electronic component according to the first comparative example differs from the electronic component 10 only in that outer conductor layers 125*a* to 125*j*, which respectively correspond to the outer conductor layers 25*a* to 25*j*, do not have the fixing portion 44. For the electronic component according to the first comparative example, the same reference signs as those used for the electronic component 10 are used to designate the same constituent elements as those of the electronic component 10.

In the electronic component 10, the area of contact of the outer conductor layers 25*a* to 25*j* with the insulator layers 16*c* to 16*m* is larger than the area of contact of the outer conductor layers 125*a* to 125*j* with the insulator layers 16*c* to 16*m* in the electronic component according to the first comparative example, by an amount equal to the area of the fixing portion 44. The force of attachment of an outer conductor layer to an insulator layer is proportional to the area of contact of the outer conductor layer with the insulator layer. Thus, the outer conductor layers 25*a* to 25*j* of the electronic component 10 are more firmly attached to the insulator layers 16*c* to 16*m* than are the outer conductor layers 125*a* to 125*j* of the electronic component according to the first comparative example. That is, the outer electrode 14*a* of the electronic component 10 is more firmly attached to the multilayer body 12 than is the outer electrode 14*a* of the electronic component according to the first comparative example. This reduces dislodging of the outer electrode 14*a* from the electronic component 10. For the electronic component 10, dislodging of the outer electrode 14*b* from the multilayer body 12 is also reduced for the same reason.

Figure 4:
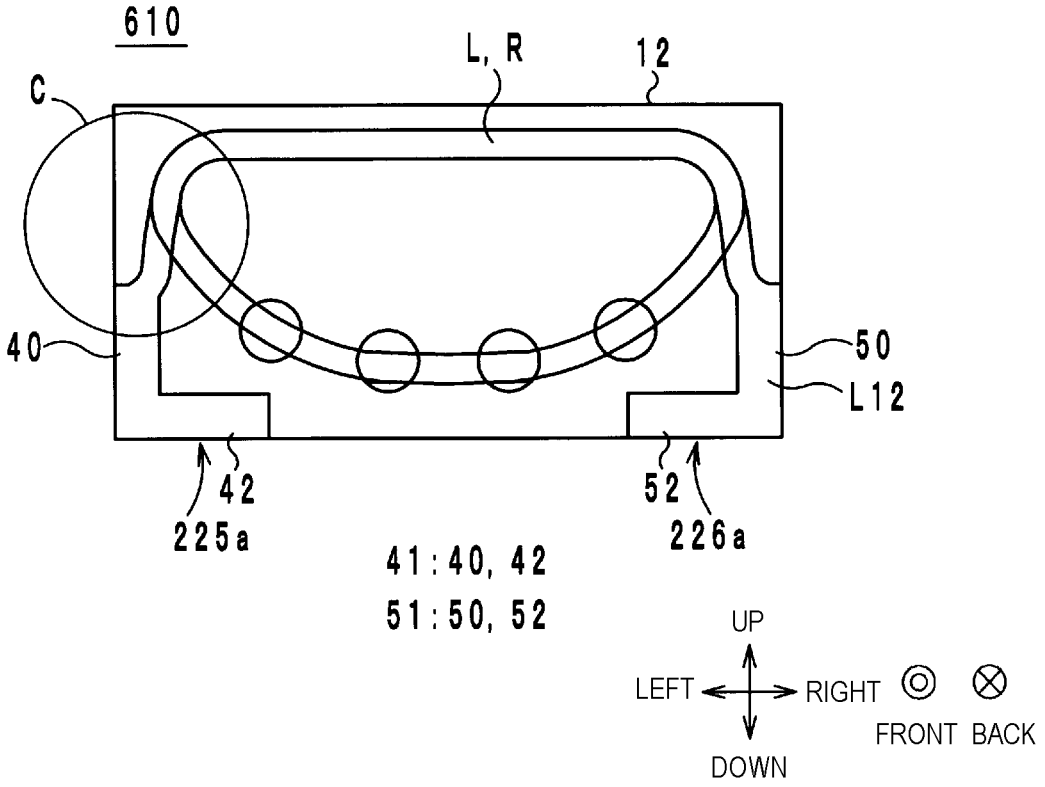
FIG. 4 is a front see-through view of a multilayer body of an electronic component according to a second comparative example.

The electronic component 10 allows the inductance of the inductor L to be obtained with improved efficiency. This is explained below with an electronic component according to a second comparative example taken as an example. FIG. 4 is a front see-through view of the multilayer body 12 of an electronic component 610 according to the second comparative example. For the electronic component 610, constituent elements that are the same as those of the electronic component 10 are designated by the same reference signs.

The electronic component 610 differs from the electronic component 10 in the configurations of outer conductor layers 225*a* to 225*j* and 226*a* to 226*j*, which respectively correspond to the outer conductor layers 25*a* to 25*j* and 26*a* to 26*j*. More specifically, each of the outer conductor layers 225*a* to 225*j* and 226*a* to 226*j* of the electronic component 610 does not have the fixing portions 44 and 54. Instead, the outer conductor layers 225*a* to 225*j* and 226*a* to 226*j* of the electronic component 610 each have a line width greater than the line width of each of the L-shaped portions 41 and 51 of the electronic component 10. As a result, the outer conductor layers 225*a* to 225*j* and 226*a* to 226*j* of the electronic component 610 each have an area substantially equal to the area of each of the outer conductor layers 25*a* to 25*j* and 26*a* to 26*j* of the electronic component 10. Like the electronic component 10, the electronic component 610 configured as described above reduces dislodging of the outer electrodes 14*a* and 14*b* from the electronic component 10. However, the comparatively greater line width of the outer conductor layers 225*a* to 225*j* and 226*a* to 226*j* in the electronic component 610 reduces the area over which the inductor L can be formed, making it difficult to increase the inside diameter of the coil of the inductor L. It is therefore difficult for the electronic component 610 to reduce dislodging of the outer electrodes 14*a* and 14*b* from the multilayer body 12 while simultaneously improving the efficiency with which the inductance of the inductor L is obtained.

By contrast, the electronic component 10 has the fixing portions 44 and 54 respectively located inside the regions A1 and A11. The presence of the fixing portions 44 and 54 ensures firm attachment of the outer conductor layers 25*a* to 25*j* and 26*a* to 26*j* to the insulator layers 16*c* to 16*m* while allowing for reduced line width of the L-shaped portions 41 and 51. The distance of the L-shaped portion 41 from the inductor conductor layers 18*a* to 18*j* and the distance of the L-shaped portion 51 from the inductor conductor layers 18*a* to 18*j* are large in the vicinity of the intersection of the strip conductor layers 40 and 42 (substantially the middle of the L-shape) and in the vicinity of the intersection of the strip conductor layers 50 and 52 (substantially the middle of the L-shape), respectively. Thus, the presence of the fixing portions 44 and 54 in the vicinity of these intersections has only a small impact on the size of the area over which the inductor L can be formed. This means that in the electronic component 10, the inductor L can be formed over a larger area than in the electronic component 610. Therefore, the electronic component 10 allows the inside diameter of the coil of the inductor L to be increased without increasing the size of the multilayer body 12, thus allowing for improved efficiency with which the inductance of the inductor L is obtained.

Further, the fixing portions 44 and 54 are respectively located inside the regions A1 and A11, and do not extend out of the regions A1 and A11. Thus, when viewed from the front, the inductor L is allowed to be positioned near the corners p1 and p11 of the insulator layers 16*d* to 16*m*, and further allowed to extend into the region A2. In particular, the fixing portion 44 does not extend out of the region A1 in the electronic component 10. This allows the inductor L to be positioned near the side L1 when viewed from the front. This makes it possible to increase the inside diameter of the coil of the inductor L. The above-mentioned configuration allows the inside diameter of the coil of the inductor L to be increased without increasing the size of the multilayer body 12, thus allowing for improved efficiency with which the inductance of the inductor L is obtained.

The electronic component 10 makes it possible to reduce dislodging of the outer electrode 14*a* from the multilayer body 12 also for the reasons stated below. The electronic component is provided with the via-hole conductors v21 to v29. The via-hole conductors v21 to v29 are located inside the multilayer body 12, and not exposed to the outside of the multilayer body 12. The via-hole conductors v21 to v29 connect the outer conductor layers 25*a* to 25*j*. If, for example, the outer conductor layers 25*a* to 25*j* are about to come off the insulator layers 16*c* to 16*m* as the outer electrode 14*a* is pulled by the circuit board, the above-mentioned configuration ensures that the via-hole conductors v21 to v29 become caught on the insulator layers 16*d* to 16*l*. As a result, dislodging of the outer electrode 14*a* from the multilayer body 12 is reduced. Dislodging of the outer electrode 14*b* from the multilayer body 12 is also reduced for the same reason.

Further, the electronic component 10 allows the flatness of the front and back faces of the multilayer body 12 to be maintained. This will be explained below with reference to an electronic component having the via-hole conductors v21 to v29 aligned in a single line, which represents an electronic component according to an exemplary implementation. The electronic component according to the exemplary implementation, which is used for the purpose of explaining the advantages of the electronic component 10, is an electronic component according to an exemplary implementation of the present disclosure.

In the electronic component according to the exemplary implementation, the via-hole conductors v21 to v29 are aligned in a single line. When the via-holes are not filled with enough conductive paste, if the via-hole conductors v21 to v29 are aligned in a single line, this may cause a large depression to form in areas of the front and back faces of the multilayer body 12 where the via-hole conductors v21 to v29 exist.

By contrast, in the electronic component 10, those of the via-hole conductors v21 to v29 which are adjacent to each other in the front-back direction do not overlap when viewed from the front. This configuration reduces formation of a large depression in the front and back faces of the multilayer body 12. This allows the flatness of the front and back faces of the multilayer body 12 to be maintained.

Furthermore, when the via-holes are not filled with enough conductive paste, the presence of the via-hole conductors v21 to v29 causes irregularities to develop in the insulator layers 16*a* to 16*p*. In this regard, in the electronic component 10, those of the via-hole conductors v21 to v29 which are adjacent to each other in the front-back direction do not overlap when viewed from the front. This configuration reduces concentration of areas where irregularities develop in the electronic component 10, thus improving the flatness of the insulator layers 16*a* to 16*p*.

The electronic component 10 minimizes decreases in the inductance of the inductor L due to the location of the outer electrodes 14*a* and 14*b*. More specifically, the inductor L has a central axis that extends in the front-back direction. Thus, the inductor L generates a large amount of magnetic flux extending in the front-back direction. In the electronic component 10, the inductor L does not overlap the outer electrodes 14*a* and 14*b* when viewed from the front. This reduces passage of the magnetic flux generated by the inductor L through the outer electrodes 14*a* and 14*b*. This minimizes decreases in the inductance of the inductor L.

First Modification

Figure 5A:
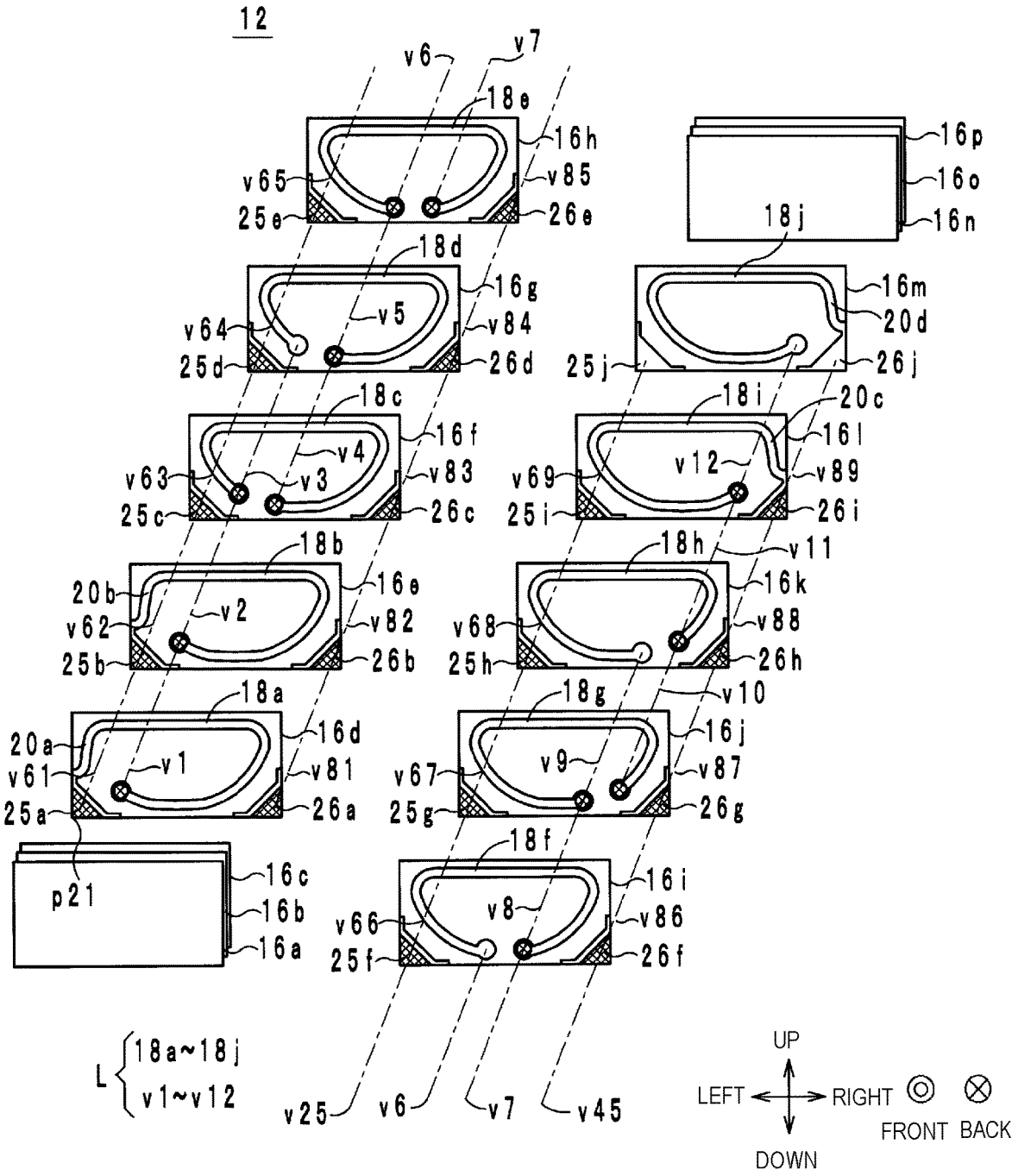
FIG. 5A is an exploded perspective view of a multilayer body of an electronic component.

The electronic component 10*a* according to a first modification will be described with reference to the drawings. FIG. 5A is an exploded perspective view of the multilayer body 12 of the electronic component 10*a*. The shaded portions in FIG. 5A indicate that the conductor extends through the insulator layer in the front-back direction. As for the external perspective view of the electronic component 10*a*, FIG. 1 is used.

The electronic component 10*a* differs from the electronic component 10 in the configurations of the outer conductor layers 25*a* to 25*j* and 26*a* to 26*j*, and in the provision of connection conductors v61 to v69 and v81 to v89 instead of the via-hole conductors v21 to v29 and v41 to v49. The following description of the electronic component 10*a* will mainly focus on such differences.

The connection conductors v61 to v69 respectively extend through the insulator layers 16*d* to 16*l* in the front-back direction. Each of the connection conductors v61 to v69 connects outer conductor layers that are adjacent to each other in the front-back direction. The connection conductors v61 to v69 respectively correspond to the shaded portions of the outer conductor layers 25*a* to 25*i*. The connection conductors v61 to v69 are disposed in the front-back direction such that each of the connection conductors v61 to v69 includes a point (first point) where the left short side and lower long side of the corresponding one of the insulator layers 16*d* to 16*l* intersect. The sections of the connection conductors v61 to v69 taken substantially perpendicular to the front-back direction have the shape of a substantially right-angled triangle. Specifically, the connection conductors v61 to v69 have the shape of a substantially triangular prism formed by a succession of substantially right-angled triangular sections extending in the front-back direction. Each of the substantially right-angled triangular sections has adjacent sides that form right angles at the point of intersection and extend along the left short side and lower long side of the corresponding one of the insulator layers 16*d* to 16*l*. The connection conductors v61 to v69 are thus exposed from the multilayer body 12 at the left and lower faces of the multilayer body 12. Like the via-hole conductors, the connection conductors v61 to v69 are each made of, for example, an electrically conductive material having Ag as a main component. The connection conductors v61 to v69 are formed through the same process as the via-hole conductors.

The connection conductor v61 connects the outer conductor layer 25*a* with the outer conductor layer 25*b*. The connection conductor v62 connects the outer conductor layer 25*b* with the outer conductor layer 25*c*. The connection conductor v63 connects the outer conductor layer 25*c* with the outer conductor layer 25*d*. The connection conductor v64 connects the outer conductor layer 25*d* with the outer conductor layer 25*e*. The connection conductor v65 connects the outer conductor layer 25*e* with the outer conductor layer 25*f*. The connection conductor v66 connects the outer conductor layer 25*f* with the outer conductor layer 25*g*. The connection conductor v67 connects the outer conductor layer 25*g* with the outer conductor layer 25*h*. The connection conductor v68 connects the outer conductor layer 25*h* with the outer conductor layer 25*i*. The connection conductor v69 connects the outer conductor layer 25*i* with the outer conductor layer 25*j*.

The connection conductors v81 to v89 respectively extend through the insulator layers 16*d* to 16*l* in the front-back direction. Each of the connection conductors v81 to v89 connects outer conductor layers that are adjacent to each other in the front-back direction. The connection conductors v81 to v89 respectively correspond to the shaded portions of the outer conductor layers 26*a* to 26*i*. The connection conductors v81 to v89 are disposed in the front-back direction such that each of the connection conductors v81 to v89 includes a point where the right short side and lower long side of the corresponding one of the insulator layers 16*d* to 16*l* intersect. The sections of the connection conductors v81 to v89 taken substantially perpendicular to the front-back direction have the shape of a substantially right-angled triangle. Specifically, the connection conductors v81 to v89 have the shape of a substantially triangular prism formed by a succession of substantially right-angled triangular sections extending in the front-back direction. Each of the substantially right-angled triangular sections has adjacent sides that form right angles at the point of intersection and extend along the right short side and lower long side of the corresponding one of the insulator layers 16*d* to 16*l*. The connection conductors v81 to v89 are thus exposed from the multilayer body 12 at the right and lower faces of the multilayer body 12. Like the via-hole conductors, the connection conductors v81 to v89 are each made of, for example, an electrically conductive material having Ag as a main component. Further, the connection conductors v81 to v89 are formed through the same process as the via-hole conductors.

The connection conductor v81 connects the outer conductor layer 26*a* with the outer conductor layer 26*b*. The connection conductor v82 connects the outer conductor layer 26*b* with the outer conductor layer 26*c*. The connection conductor v83 connects the outer conductor layer 26*c* with the outer conductor layer 26*d*. The connection conductor v84 connects the outer conductor layer 26*d* with the outer conductor layer 26*e*. The connection conductor v85 connects the outer conductor layer 26*e* with the outer conductor layer 26*f*. The connection conductor v86 connects the outer conductor layer 26*f* with the outer conductor layer 26*g*. The connection conductor v87 connects the outer conductor layer 26*g* with the outer conductor layer 26*h*. The connection conductor v88 connects the outer conductor layer 26*h* with the outer conductor layer 26*i*. The connection conductor v89 connects the outer conductor layer 26*i* with the outer conductor layer 26*j*.

It is assumed that each outer conductor layer has a thickness substantially equal to the thickness of the inductor conductor layer disposed on the same insulator layer. That is, an outer conductor layer refers to the portion extending from the front face of the insulator layer up to the thickness of the inductor conductor layer. A connection conductor refers to the portion that connects outer conductor layers that are adjacent to each other in the front-back direction.

In the electronic component 10*a*, the hypotenuse of the fixing portions 44 and 54 is a substantially straight line. However, the hypotenuse of the fixing portions 44 and 54 may have irregularities.

In the electronic component 10*a*, the lower left corner of the insulator layers 16*d* to 16*l* is cut away. Thus, the insulator layers 16*d* to 16*l* do not have the corner p1. Accordingly, a virtual point p21 (an example of a first point), which is the intersection of the left short side and lower long side of the insulator layers 16*d* to 16*l*, is defined for the electronic component 10*a* instead of the corner p1. In the electronic component 10*a*, the outer conductor layers 25*a* to 25*i* are disposed at the point p21 instead of the corner p1. For the same reason, the outer conductor layers 26*a* to 26*i* are disposed at the point of intersection of the right short side and lower long side of the insulator layers 16*d* to 16*l*, instead of the corner p11.

Like the electronic component 10, the electronic component 10*a* configured as described above makes it possible to reduce dislodging of the outer electrode 14*a* from the multilayer body 12. This will be explained below in greater detail. The configuration of the fixing portions 44 and 54 of the electronic component 10*a* differs from the configuration of the fixing portions 44 and 54 of the electronic component 10. However, as with the electronic component 10, the presence of the fixing portions 44 and 54 in the electronic component 10*a* increases the area of contact of the outer conductor layers 25*a* to 25*j* and 26*a* to 26*j* with the insulator layers 16*c* to 16*m* in comparison to the electronic component according to the first comparative example. Therefore, like the electronic component 10, the electronic component 10*a* makes it possible to reduce dislodging of the outer electrode 14*a* from the multilayer body 12.

Like the electronic component 10, the electronic component 10*a* allows the inductance of the inductor L to be obtained with improved efficiency. This will be explained below in greater detail. The configuration of the fixing portions 44 and 54 of the electronic component 10*a* differs from the configuration of the fixing portions 44 and 54 of the electronic component 10. However, like the electronic component 10, the electronic component 10*a* has the fixing portions 44 and 54 respectively located inside the regions A1 and A11. This ensures improved attachment of the outer conductor layers 25*a* to 25*j* and 26*a* to 26*j* to the insulator layers 16*c* to 16*m* while allowing for reduced line width of the L-shaped portions 41 and 51. The distance of the L-shaped portion 41 from the inductor conductor layers 18*a* to 18*j* and the distance of the L-shaped portion 51 from the inductor conductor layers 18*a* to 18*j* are large in the vicinity of the intersection of the strip conductor layers 40 and 42 (substantially the middle of the L-shape) and in the vicinity of the intersection of the strip conductor layers 50 and 52 (substantially the middle of the L-shape), respectively. Thus, the presence of the fixing portions 44 and in the vicinity of these intersections has only a small impact on the size of the area over which the inductor L can be formed. As a result, in the electronic component 10*a*, the inductor L can be formed over a larger area than in the electronic component 610 illustrated in FIG. 4. Therefore, the electronic component 10*a* allows the inside diameter of the coil of the inductor L to be increased without increasing the size of the multilayer body 12, thus allowing for improved efficiency with which the inductance of the inductor L is obtained.

For the same reason as with the electronic component 10, the electronic component 10*a* minimizes decreases in the inductance of the inductor L caused by the presence of the outer electrodes 14*a* and 14*b*.

Second Modification

Figure 5B:
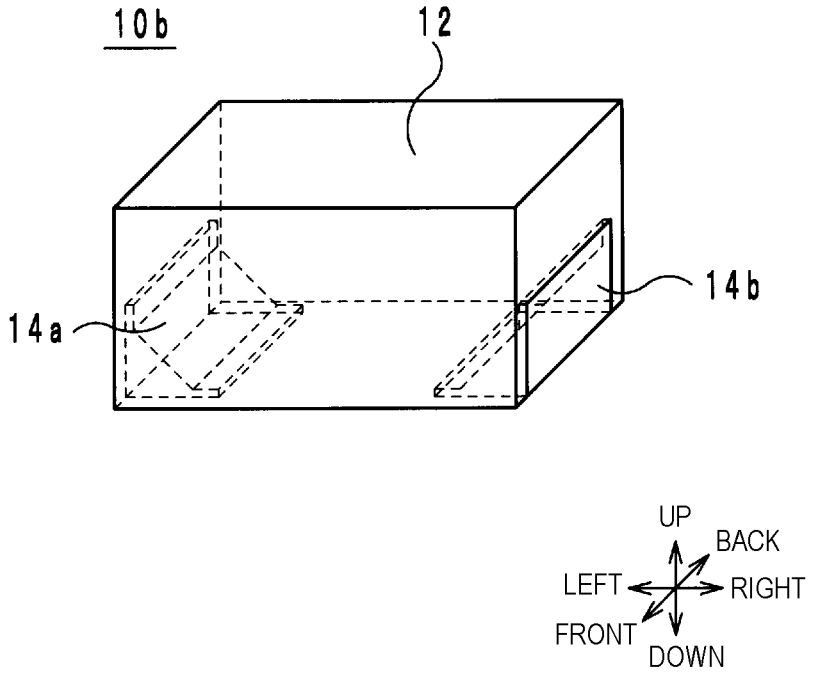
FIG. 5B is an exploded perspective view of a multilayer body of an electronic component.

An electronic component 10*b* according to a second modification will be described below with reference to the drawings. FIG. 5B is an exploded perspective view of the multilayer body 12 of the electronic component 10*b*.

The electronic component 10*b* differs from the electronic component 10*a* in the configuration of the outer electrodes 14*a* and 14*b*. The following description of the electronic component 10*b* will mainly focus on such differences.

In the electronic component 10*a*, the connection conductors v61 to v69 have a substantially triangular shape. Thus, when viewed from the front, the connection conductors v61 to v69 do not have portions corresponding to the strip conductor layers 40 and 42.

By contrast, in the electronic component 10*b*, the connection conductors v61 to v69 have the same shape and size as the outer conductor layers 25*a* to 25*j* when viewed from the front. The outer electrode 14*a* thus has substantially the same sectional shape at any location in the front-back direction. The outer electrode 14*b* also has the same structure as the outer electrode 14*a*.

For the electronic component 10*b* mentioned above as well, the presence of the fixing portion 44 in the outer conductor layers 25*a* and 25*j* allows for firm attachment of the outer conductor layers 25*a* and 25*j* to the insulator layers 16*c* and 16*m*, respectively. As a result, dislodging of the outer electrode 14*a* from the multilayer body 12 is reduced. Further, dislodging of the outer electrode 14*b* from the multilayer body 12 is also reduced for the same reason.

Modifications of Outer Conductor Layers

Figure 6A:
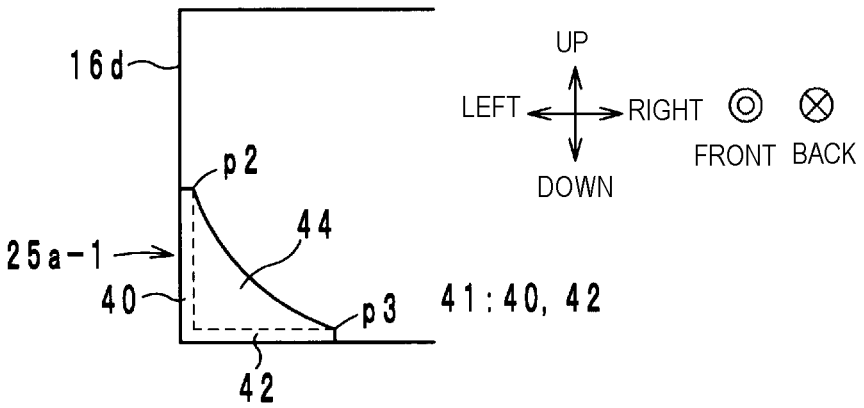
FIG. 6A illustrates an outer conductor layer according to a first modification.
Figure 6B:
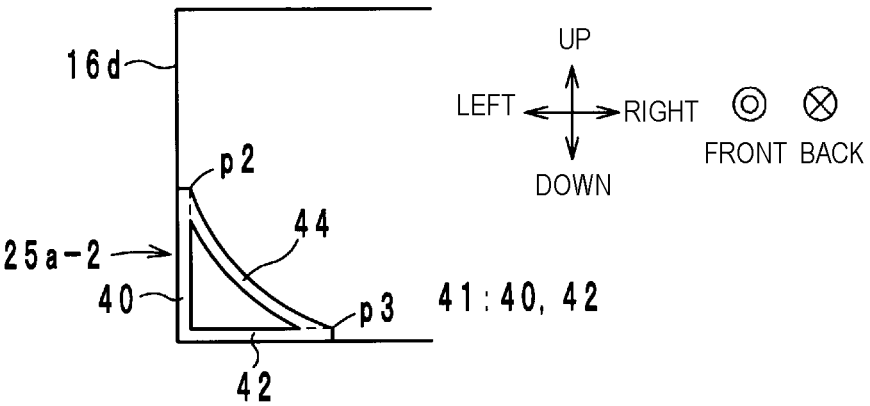
FIG. 6B illustrates an outer conductor layer according to a second modification.
Figure 6C:
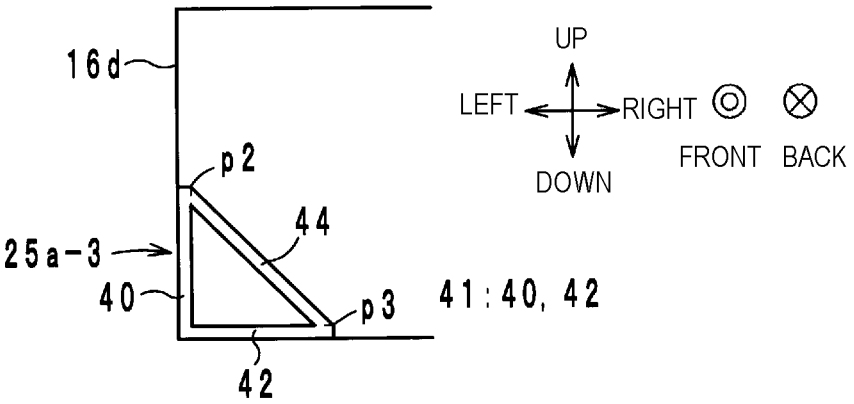
FIG. 6C illustrates an outer conductor layer according to a third modification.
Figure 7A:
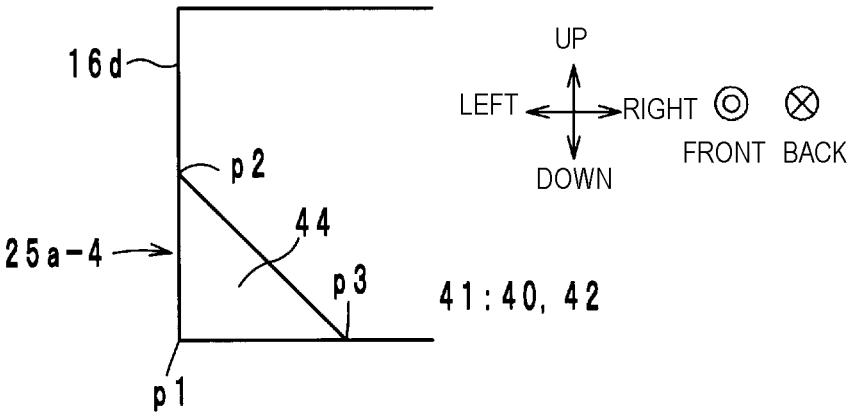
FIG. 7A illustrates an outer conductor layer according to a fourth modification.
Figure 7B:
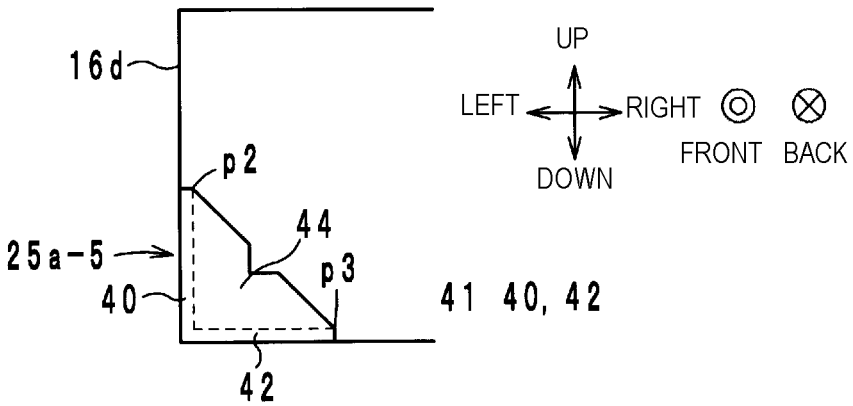
FIG. 7B illustrates an outer conductor layer according to a fifth modification.
Figure 7C:
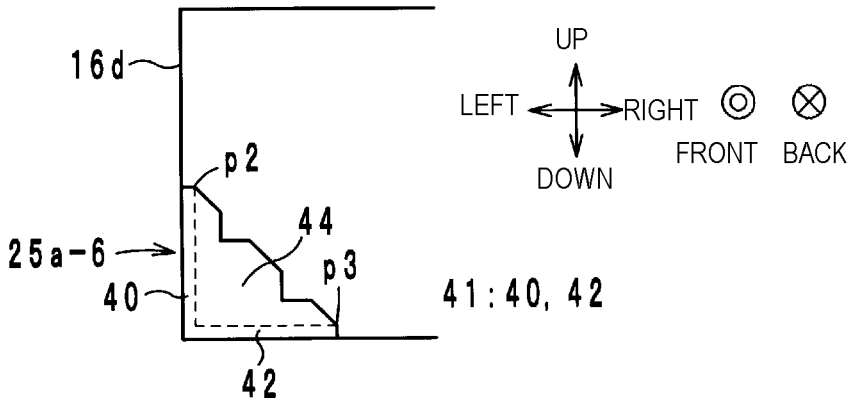
FIG. 7C illustrates an outer conductor layer according to a sixth modification.
Figure 8A:
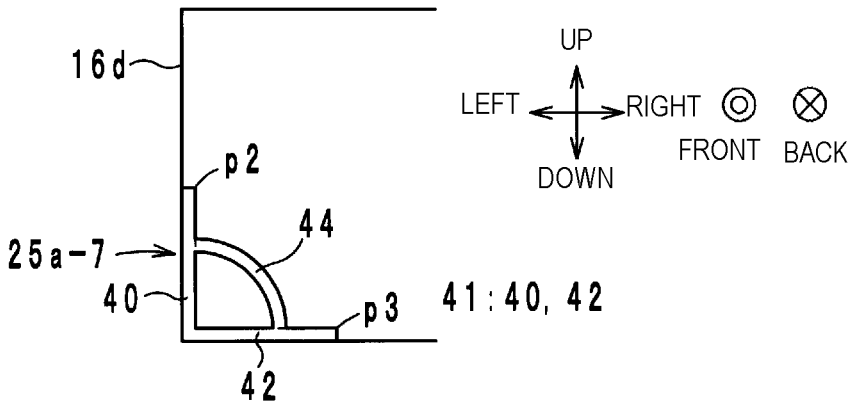
FIG. 8A illustrates an outer conductor layer according to a seventh modification.
Figure 8B:
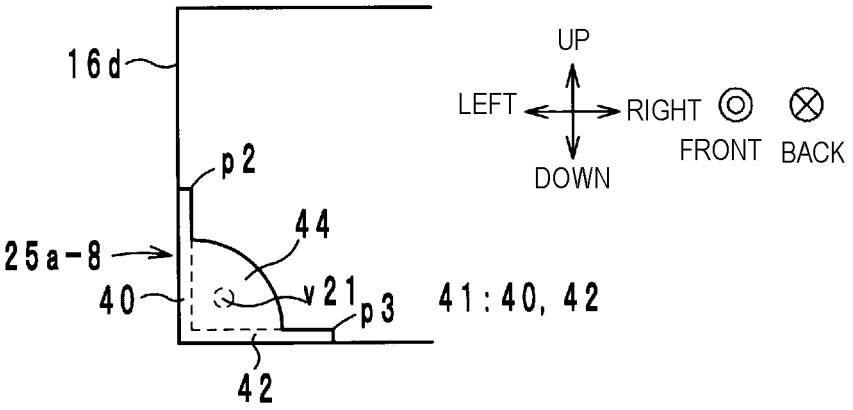
FIG. 8B illustrates an outer conductor layer according to an eighth modification.
Figure 8C:
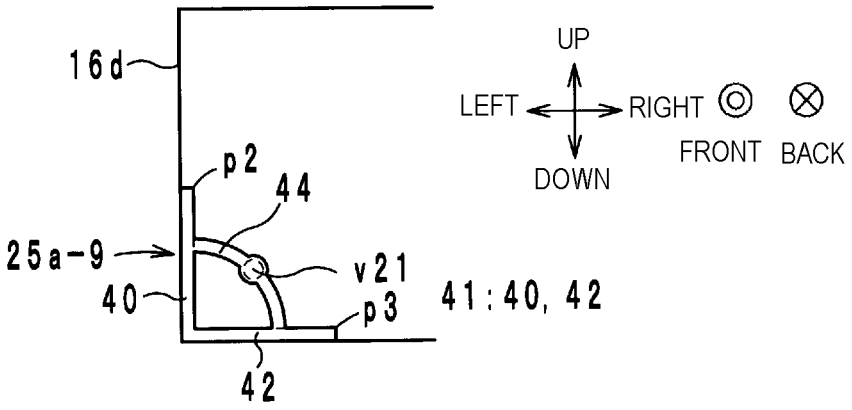
FIG. 8C illustrates an outer conductor layer according to a ninth modification.
Figure 9A:
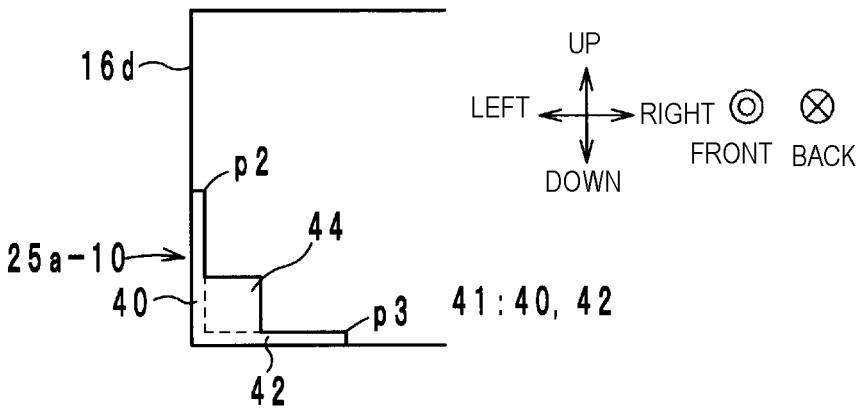
FIG. 9A illustrates an outer conductor layer according to a tenth modification.
Figure 9B:
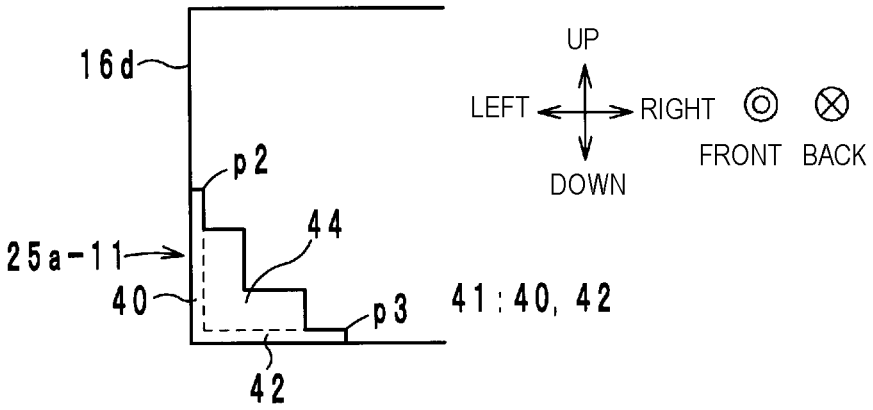
FIG. 9B illustrates an outer conductor layer according to an eleventh modification.
Figure 9C:
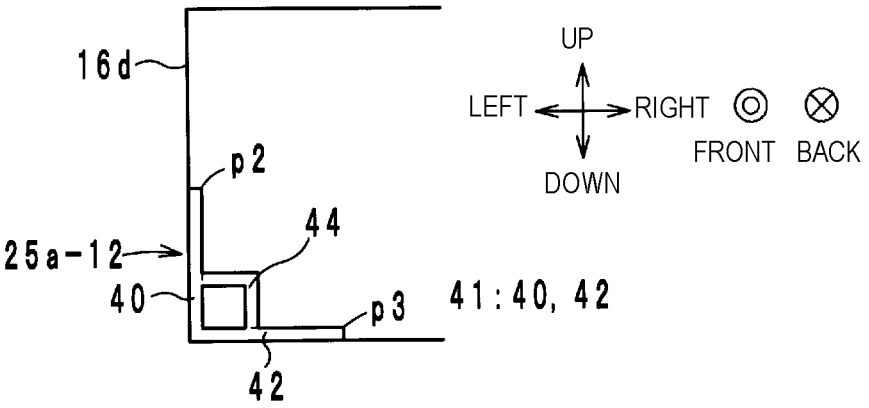
FIG. 9C illustrates an outer conductor layer according to a twelfth modification.
Figure 10A:
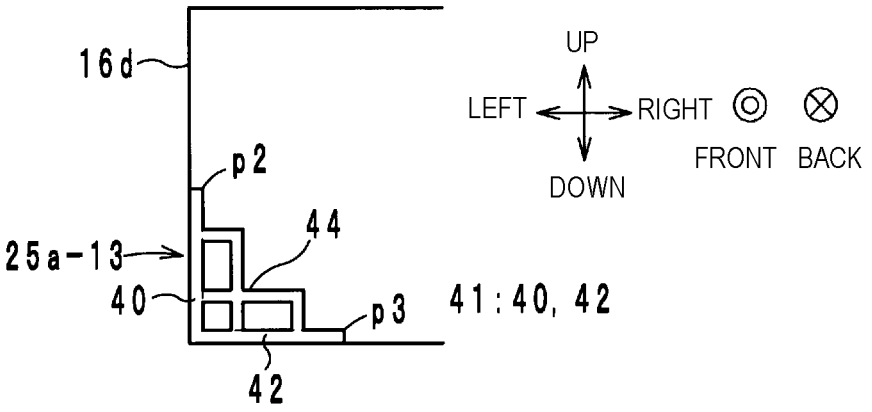
FIG. 10A illustrates an outer conductor layer according to a thirteenth modification.
Figure 10B:
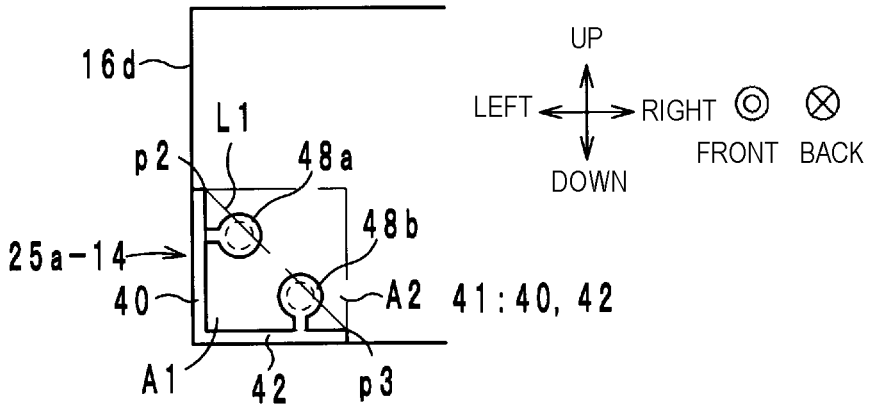
FIG. 10B illustrates an outer conductor layer according to a fourteenth modification.
Figure 10C:
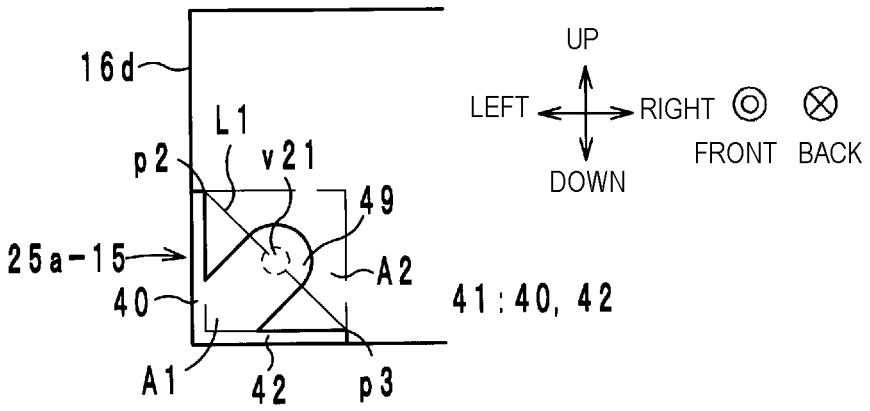
FIG. 10C illustrates an outer conductor layer according to a fifteenth modification.
Figure 11:
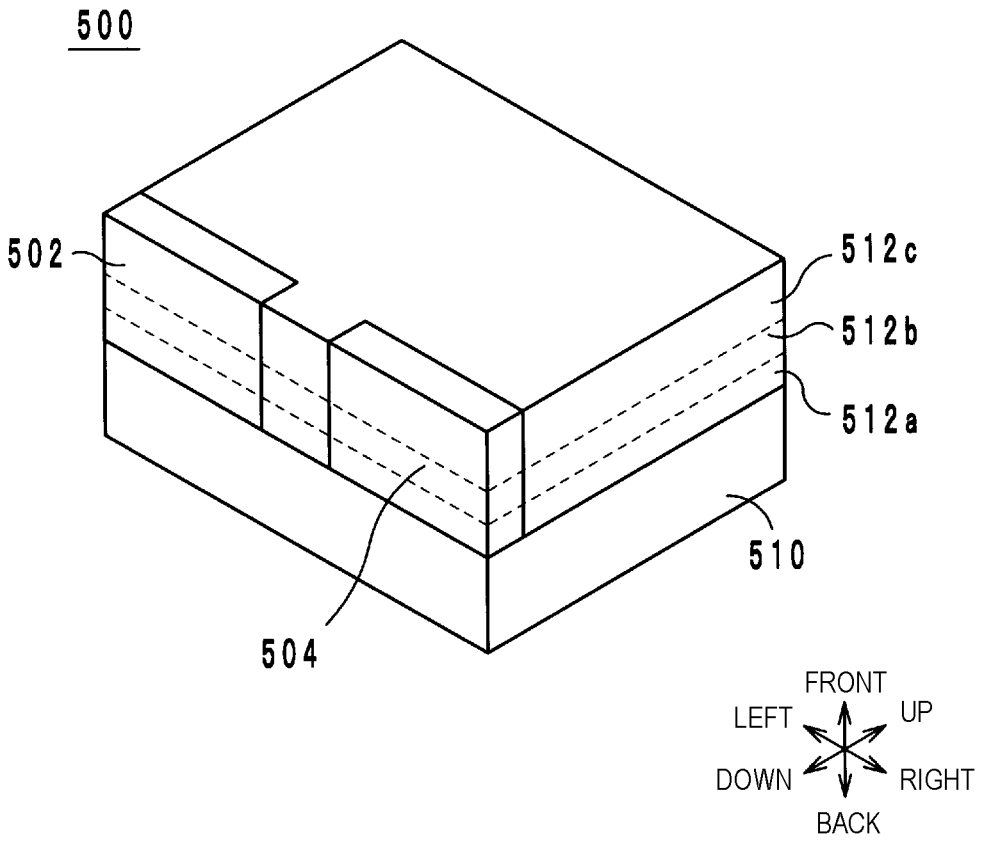
FIG. 11 is an external perspective view of an inductor.

The outer conductor layers 25*a* to 25*j* and 26*a* to 26*j* according to modifications will be described below with reference to the drawings. In the following, the outer conductor layer 25*a* will be described by way of example. FIG. 6A illustrates an outer conductor layer 25*a*-1 according to a first modification. FIG. 6B illustrates an outer conductor layer 25*a*-2 according to a second modification. FIG. 6C illustrates an outer conductor layer 25*a*-3 according to a third modification. FIG. 7A illustrates an outer conductor layer 25*a*-according to a fourth modification. FIG. 7B illustrates an outer conductor layer 25*a*-5 according to a fifth modification. FIG. 7C illustrates an outer conductor layer 25*a*-6 according to a sixth modification. FIG. 8A illustrates an outer conductor layer 25*a*-7 according to a seventh modification. FIG. 8B illustrates an outer conductor layer 25*a*-8 according to an eighth modification. FIG. 8C illustrates an outer conductor layer 25*a*-9 according to a ninth modification. FIG. 9A illustrates an outer conductor layer 25*a*-10 according to a tenth modification. FIG. 9B illustrates an outer conductor layer 25*a*-11 according to an eleventh modification. FIG. 9C illustrates an outer conductor layer 25*a*-12 according to a twelfth modification. FIG. 10A illustrates an outer conductor layer 25*a*-13 according to a thirteenth modification. FIG. 10B illustrates an outer conductor layer 25*a*-14 according to a fourteenth modification. FIG. 10C illustrates an outer conductor layer 25*a*-15 according to a fifteenth modification.

As illustrated in FIG. 6A, the fixing portion 44 of the outer conductor layer 25*a*-1 according to the first modification has a hypotenuse having a substantially arcuate shape that is concave toward the lower left when viewed in the stacking direction. In the following description, the hypotenuse of the fixing portion 44 means the outer edge connecting the point p2 and the point p3 of the corresponding outer conductor layer. As illustrated in FIG. 6B, the outer conductor layer 25*a*-2 according to the second modification has substantially the same outer shape as the outer conductor layer 25*a*-1. An area with no conductor exists inside the outer conductor layer 25*a*-2, and thus the outer conductor layer 25*a*-2 has a frame-like configuration when viewed in the stacking direction. As illustrated in FIG. 6C, the outer conductor layer 25*a*-3 according to the third modification has a substantially triangular frame-like configuration. The frame-like configuration of the outer conductor layers 25*a*-2 and 25*a*-3 allows the insulator layer 16*c* and the insulator layer 16*d* to contact each other inside the outer conductor layers 25*a*-2 and 25*a*-3. This further reduces dislodging of the outer electrode 14*a* from the multilayer body 12.

As illustrated in FIG. 7A, the outer conductor layer 25*a*-4 according to the fourth modification has a substantially triangular shape. In the portion of the outer conductor layer 25*a*-4 where the conductor layer extends upward uninterruptedly from the lower long side of the insulator layer 16*d*, the portion located farthest upward from the point p1 is defined as the portion P1. The upper corner of the outer conductor layer 25*a*-4 corresponds to the portion P1. Further, the position on the portion P1 located farthest to the right from the point p1 is defined as the point p2. Since the portion P1 is a corner, the point p2 coincides with the portion P1. In the portion of the outer conductor layer 25*a*-4 where the conductor layer extends rightward uninterruptedly from the left short side of the insulator layer 16*d*, the portion located farthest to the right from the point p1 is defined as the portion P2. The right corner of the outer conductor layer 25*a*-4 corresponds to the portion P2. Further, the position on the portion P2 located farthest upward from the point p2 is defined as the point p3. Since the portion P2 is a corner, the point p3 coincides with the portion P2. As described above, for the outer conductor layer 25*a*-4, the points p2 and p3 coincide with corners of its triangle. Therefore, the outer conductor layer 25*a*-4 does not have the L-shaped portion 41 but only has the fixing portion 44. As described above, in an electronic component including the outer conductor layer 25*a*-4, the outer conductor layer 25*a*-4 includes the fixing portion 44 to improve the attachment between the insulator layer 16*d* and the outer conductor layer 25*a*-4. Thus, an electronic component including the outer conductor layer 25*a*-4 makes it possible to reduce dislodging of the outer electrode 14*a* from the multilayer body 12 in comparison to the electronic component according to the first comparative example having the outer conductor layers 125*a* to 125*j* that do not include the fixing portion 44.

As illustrated in FIGS. 7B and 7C, the outer conductor layer 25*a*-5 according to the fifth modification and the outer conductor layer 25*a*-6 according to the sixth modification each have a cut made in the hypotenuse of the triangle, and also have a cut made at each end of the hypotenuse. That is, the hypotenuse has irregularities. Due to the presence of a cut at each end of the hypotenuse, the outer conductor layers 25*a*-5 and 25*a*-6 each have the L-shaped portion 41. The presence of a cut in the hypotenuse provides anchorage effect between the outer conductor layers 25*a*-5 and 25*a*-6 and the insulator layer 16*c* for improved attachment between these components. As illustrated in FIG. 7B, the cut is located substantially in the middle of the hypotenuse of the fixing portion 44 between the point p2 and the point p3. This allows the inductor conductor layer to be disposed along the cut to reduce coil diameter.

As illustrated in FIG. 8A, the outer conductor layer 25*a*-7 according to the seventh modification has the fixing portion 44 having the shape of a substantially arcuate strip. As illustrated in FIG. 8B, the outer conductor layer 25*a*-8 according to the eighth modification has the fixing portion 44 having a substantially arcuate shape. The outer conductor layer 25*a*-8 may or may not be connected to the adjacent outer conductor layer 25*b*-8 by the via-hole conductor v21.

As illustrated in FIG. 8C, the outer conductor layer 25*a*-9 according to the ninth modification has a shape such that a part of the fixing portion 44 of the outer conductor layer 25*a*-7 is increased in thickness. That is, the fixing portion 44 includes a portion having a substantially arcuate shape. This allows the via-hole conductor v21 to be connected to the portion of the fixing portion 44 that is increased in thickness. The frame-like configuration of the outer conductor layers 25*a*-7 and 25*a*-9 allows the insulator layer 16*c* and the insulator layer 16*d* to contact each other inside the outer conductor layers 25*a*-7 and 25*a*-9. This further reduces dislodging of the outer electrode 14*a* from the multilayer body 12.

As illustrated in FIGS. 9A and 9B, the outer conductor layer 25*a*-10 according to the tenth modification and the outer conductor layer 25*a*-11 according to the eleventh modification each have a substantially stepped configuration. As illustrated in FIG. 9C, the outer conductor layer 25*a*-12 according to the twelfth modification has substantially the same outer shape as the outer conductor layer 25*a*-10. Due to the presence of an area with no conductor inside the outer conductor layer 25*a*-12, the outer conductor layer 25*a*-12 has a frame-like configuration. Likewise, as illustrated in FIG. 10A, the outer conductor layer 25*a*-13 according to the thirteenth modification has substantially the same outer shape as the outer conductor layer 25*a*-11. Due to the presence of an area with no conductor inside the outer conductor layer 25*a*-13, the outer conductor layer 25*a*-13 has a frame-like configuration. The stepped configuration of the outer conductor layers 25*a*-10 and 25*a*-11 as illustrated in FIGS. 9A and 9B provides the hypotenuse with recesses. This allows the inductor conductor layer to be disposed along the recesses to increase coil diameter. The stepped configuration of the hypotenuse in FIGS. 9A to 9C and FIG. 10A provides an anchorage effect between the outer conductor layers 25*a*-10 to 25*a*-13 and the insulator layer 16*c* for improved attachment between these components. The frame-like configuration of the outer conductor layers 25*a*-12 and 25*a*-13 allows the insulator layer 16*c* and the insulator layer 16*d* to contact each other inside the outer conductor layers 25*a*-12 and 25*a*-13. This further reduces dislodging of the outer electrode 14*a* from the multilayer body 12.

As illustrated in FIG. 10B, the outer conductor layer 25*a*-14 according to the fourteenth modification has substantially circular conductor layers 48*a* and 48*b* connected to the L-shaped portion 41. The fixing portion 44 corresponds to the portion of the circular conductor layers 48*a* and 48*b* located inside the region A1. At least one via-hole conductor is connected to at least one of the circular conductor layers 48*a* and 48*b* to connect two outer conductor layers that are adjacent to each other in the front-back direction. Two outer conductor layers that are adjacent to each other in the front-back direction may be either connected by two via-hole conductors or connected by a single via-hole conductor. If two via-hole conductors are used to connect two outer conductor layers that are adjacent to each other in the front-back direction, a via-hole conductor is connected to each of the circular conductor layers 48*a* and 48*b*. If a single via-hole conductor is used to connect two outer conductor layers that are adjacent to each other in the front-back direction, a via-hole conductor is connected to either one of the circular conductor layers 48*a* and 48*b*. In this case, preferably, the via-hole conductor connected to the circular conductor layer 48*a*, and the via-hole conductor connected to the circular conductor layer 48*b* are arranged alternately in the front-back direction. Like the fixing portion 44, the portion of the circular conductor layers 48*a* and 48*b* located outside the region A1 also contributes to increasing the area of contact of the outer conductor layer 25*a*-14 with the insulator layer 16*d*. Therefore, the portion of the circular conductor layers 48*a* and 48*b* located outside the region A1 also contributes to reducing dislodging of the outer electrode 14*a* from the multilayer body 12.

In the outer conductor layer 25*a*-14, the circular conductor layer 48*a* projects rightward from the L-shaped portion 41. The circular conductor layer 48*b* projects upward from the L-shaped portion 41. This provides an anchorage effect between the outer conductor layer 25*a*-14 and the insulator layer 16*c* for improved attachment between these components.

As illustrated in FIG. 10C, the outer conductor layer 25*a*-15 according to the fifteenth modification has a protrusion conductor layer 49 that protrudes upward to the right from the corner of the L-shaped portion 41. The fixing portion 44 corresponds to the portion of the protrusion conductor layer 49 located inside the region A1. The protrusion conductor layer 49 may or may not be connected with the via-hole conductor v21.

In the outer conductor layer 25*a*-15, the protrusion conductor layer 49 protrudes upward to the right from the L-shaped portion 41. This provides an anchorage effect between the outer conductor layer 25*a*-15 and the insulator layer 16*c* for improved attachment between these components.

In the outer conductor layers 25*a*-14 and 25*a*-15, the circular conductor layers 48*a* and 48*b* and the protrusion conductor layer 49 cross the side L1 to extend out of the region A1. The outer conductor layer may extend out of the region A1 in this way. However, from the viewpoint of increasing the inside diameter of the coil of the inductor L, preferably, the outer conductor layer does not extend out of the region A2.

The electronic components including the outer conductor layers 25*a*-1 to 25*a*-15 provide the same operational effect as the electronic component 10.

OTHER EMBODIMENTS

The electronic component according to the present disclosure is not limited to the electronic component 10, 10*a*, or 10*b* but may be changed or altered within the scope of the disclosure.

The configurations of the electronic components 10, 10*a*, and 10*b* and the outer conductor layers 25*a*-1 to 25*a*-15 may be combined in any way.

The inductor conductor layers 18*a* to 18*j* are respectively disposed on the same insulator layers 16*d* to 16*m* as the outer conductor layers 25*a* to 25*j* and 26*a* to 26*j*. However, one or more of the insulator layers 16*d* to 16*m* on which the inductor conductor layers 18*a* to 18*j* are disposed may not be provided with an outer conductor layer. Likewise, one or more of the insulator layers 16*d* to 16*m* on which the outer conductor layers 25*a* to 25*j* and 26*a* to 26*j* are disposed may not be provided with the inductor conductor layers 18*a* to 18*j*. Therefore, it suffices if at least one of the outer conductor layers 25*a* to 25*j* and 26*a* to 26*j*, and at least one of the inductor conductor layers 18*a* to 18*j* are disposed on the same insulator layer.

The electronic components 10, 10*a*, and 10*b* may be fabricated by a sheet lamination method in which ceramic green sheets each provided with a conductor layer are stacked and pressure-bonded one by one to form an unfired multilayer body, and then the unfired multilayer body is fired. Alternatively, the electronic components 10, 10*a*, and 10*b* may be fabricated by a printing lamination method in which, on the principal surface of the corresponding insulator layer, the inductor conductor layer and the insulator layer are formed on a half-by-half basis.

Although the inductor L is substantially in the form of a helix, the inductor L may be substantially in the form of a spiral. A helix refers to a three-dimensional spiral structure, whereas a spiral refers to a two-dimensional spiral structure. If the inductor L is in a spiral form, the boundary between an inductor conductor layer and a lead conductor layer refers to the location where the conductor leaves the spiral track.

Although the outer conductor layers 25*a* to 25*j* all have substantially the same shape in the foregoing description, one or more of the outer conductor layers 25*a* to 25*j* may differ in shape from the other conductor layers. That is, it suffices if at least one (an example of a first outer conductor layer) of the outer conductor layers 25*a* to 25*j* has the fixing portion 44, in which case the other outer conductor layers may be of a substantially L-shape that does not have the fixing portion 44. However, preferably, at least two (an example of first outer conductor layers) of the outer conductor layers 25*a* to 25*j* have the fixing portion 44. It is to be noted, however, that the outer conductor layers having the fixing portion 44 are preferably outer conductor layers that are not connected with the lead conductor layers 20*a* and 20*b*. The same as explained above for the outer conductor layers 25*a* to 25*j* equally applies to the outer conductor layers 26*a* to 26*j*. It suffices if at least one of the outer conductor layers 25*a* to 25*j* or at least one of the outer conductor layers 26*a* to 26*j* has the fixing portion 44 or 54. That is, it suffices if at least one of either the outer conductor layers 25*a* to 25*j* or the outer conductor layers 26*a* to 26*j* is provided with the fixing portion 44 or 54.

For example, the outer conductor layer 25*a* may have the fixing portion 44, and the outer conductor layer 25*b* may not have the fixing portion 44. In this case, the via-hole conductor v21 connects the L-shaped portion 41 of the outer conductor layer 25*a* with the L-shaped portion 41 of the outer conductor layer 25*b*.

The via-hole conductors v21 to v29 and v41 to v49, and the connection conductors v61 to v69 and v81 to v89 may not be provided.

The outer conductor layers 25*a* to 25*j*, 26*a* to 26*j*, and 25*a*-1 to 25*a*-15, the inductor conductor layers 18*a* to 18*j*, the lead conductor layers 20*a* to 20*d*, the via-hole conductors v21 to v29 and v41 to v49, and the connection conductors v61 to v69 and v81 to v89 may each be formed by, other than application of a coating of conductive paste, methods such as sputtering, vapor deposition, pressure-bonding of a foil, and plating. The outer conductor layers 25*a* to 25*j*, 26*a* to 26*j*, and 25*a*-1 to 25*a*-15, the inductor conductor layers 18*a* to 18*j*, the lead conductor layers 20*a* to 20*d*, the via-hole conductors v21 to v29 and v41 to v49, and the connection conductors v61 to v69 and v81 to v89 may each have, other than Ag, a conductor material with low electrical resistance, such as Cu or Au, as a main component.

The through-holes for via-hole conductors may be formed by laser beam irradiation, drilling, or other methods.

The insulator layers 16*a* to 16*p* may be made of, other than glass or ceramic materials, organic materials such as epoxy resin, fluorine resin, or polymer resin, or compound materials such as glass epoxy resin. It is to be noted, however, that the insulator layers 16*a* to 16*p* are preferably made of materials with low dielectric constant and low dielectric loss.

The electronic components 10, 10*a*, and 10*b* may not necessarily have a size of about 0.4 mm×0.2 mm×0.2 mm.

The via-hole conductors v21 to v29 connect the fixing portions 44 of outer conductor layers that are adjacent to each other in the front-back direction. Likewise, the via-hole conductors v41 to v49 connect the fixing portions 54 of outer conductor layers that are adjacent to each other in the front-back direction. However, the via-hole conductors v21 to v29 and v41 to v49 may connect outer conductors layers that are adjacent to each other in the front-back direction, at locations other than the fixing portions 44 and 54.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a multilayer body including a plurality of insulator layers stacked in a stacking direction, the insulator layers each having a substantially rectangular principal face that has a first side and a second side, the first side on a line extending in a first direction from a first point, the second side on a line extending in a second direction from the first point, the second direction being substantially perpendicular to the first direction;

an outer electrode including a plurality of outer conductor layers that, when viewed in the stacking direction, extends along the first direction and the second direction from the first point, the outer conductor layers being exposed from the multilayer body;

an inductor having a substantially helical configuration where a central axis extends in the stacking direction, the inductor including a plurality of inductor conductor layers disposed on the different insulator layers each other; and a lead conductor layer that connects one of the outer conductor layers with one of the inductor conductor layers, wherein each of the outer conductor layers has a first portion located farthest from the first point along the first direction in an uninterruptedly extending part of the outer conductor layer from the first point along the first direction, wherein the first portion has a second point located farthest from the first point along the second direction, wherein each of the outer conductor layers has a second portion located farthest from the first point along the second direction in an uninterruptedly extending part of the outer conductor layer from the first point along the second direction, wherein the second portion has a third point located farthest from the first point along the first direction, wherein the outer conductor layers include a first outer conductor layer, and wherein the first outer conductor layer has a fixing portion different from the lead conductor layer, the fixing portion being located inside a first region of a substantially triangular shape having a third side, a fourth side, and a fifth side, the third side connecting the second point with the third point, the fourth side extending from the second point in a reverse direction of the first direction, the fifth side extending from the third point in a reverse direction of the second direction, wherein the first outer conductor layer has a substantially stepped configuration when viewed in the stacking direction, the fixing portion being included in the substantially stepped configuration.

2. The electronic component according to claim 1, wherein the fixing portion is configured as the substantially stepped configuration when viewed in the stacking direction.

3. The electronic component according to claim 1, wherein the fixing portion has a first edge positioned between the fifth side and the second point and extending in the second direction and a second edge positioned between the fourth side and the third point and extending in the first direction.

4. The electronic component according to claim 3, wherein the first and second edges meet at a corner of the fixing portion.

5. The electronic component according to claim 3, wherein an end of the first edge opposite to the corner is at the fourth side and an end of the second edge opposite to the corner is at the fifth side.

6. The electronic component according to claim 1, wherein the fixing portion has a substantially square shaped portion in plan view when viewed in the stacking direction.

7. The electronic component according to claim 1, wherein the outer electrode further includes an interlayer connection conductor, the interlayer connection conductor extending through one of the insulator layers in the stacking direction and connecting two of the outer conductor layers.

8. The electronic component according to claim 7, wherein the outer conductor layer includes a plurality of the first outer conductor layers, and wherein the fixing portions of the first outer conductor layers are connected by the interlayer connection conductor each other.

9. An electronic component comprising:

a multilayer body including a plurality of insulator layers stacked in a stacking direction, the insulator layers each having a substantially rectangular principal face that has a first side and a second side, the first side on a line extending in a first direction from a first point, the second side on a line extending in a second direction from the first point, the second direction being substantially perpendicular to the first direction;

an outer electrode including a plurality of outer conductor layers that, when viewed in the stacking direction, extends along the first direction and the second direction from the first point, the outer conductor layers being exposed from the multilayer body;

an inductor having a substantially helical configuration where a central axis extends in the stacking direction, the inductor including a plurality of inductor conductor layers disposed on the different insulator layers each other; and a lead conductor layer that connects one of the outer conductor layers with one of the inductor conductor layers, wherein each of the outer conductor layers has a first portion located farthest from the first point along the first direction in an uninterruptedly extending part of the outer conductor layer from the first point along the first direction, wherein the first portion has a second point located farthest from the first point along the second direction, wherein each of the outer conductor layers has a second portion located farthest from the first point along the second direction in an uninterruptedly extending part of the outer conductor layer from the first point along the second direction, wherein the second portion has a third point located farthest from the first point along the first direction, wherein the outer conductor layers include a first outer conductor layer, and wherein the first outer conductor layer has a fixing portion different from the lead conductor layer, the fixing portion being located inside a first region of a substantially triangular shape having a third side, a fourth side, and a fifth side, the third side connecting the second point with the third point, the fourth side extending from the second point in a reverse direction of the first direction, the fifth side extending from the third point in a reverse direction of the second direction, wherein the fixing portion, when viewed in the stacking direction, has a first edge extending in the second direction from a first location at the fourth side between the first point and the second point and a second edge extending in the first direction from a second location at the fifth side between the first point and the third point.

10. The electronic component according to claim 9, wherein the fixing portion has a substantially stepped configuration when viewed in the stacking direction.

11. The electronic component according to claim 9, wherein the first and second edges meet at a corner of the fixing portion.

12. The electronic component according to claim 9, wherein the fixing portion has a substantially square shaped portion in plan view when viewed in the stacking direction.

13. The electronic component according to claim 9, wherein the outer electrode further includes an interlayer connection conductor, the interlayer connection conductor extending through one of the insulator layers in the stacking direction and connecting two of the outer conductor layers.

14. The electronic component according to claim 13, wherein the outer conductor layer includes a plurality of the first outer conductor layers, and wherein the fixing portions of the first outer conductor layers are connected by the interlayer connection conductor each other.

15. An electronic component comprising:

a multilayer body including a plurality of insulator layers stacked in a stacking direction, the insulator layers each having a substantially rectangular principal face that has a first side and a second side, the first side on a line extending in a first direction from a first point, the second side on a line extending in a second direction from the first point, the second direction being substantially perpendicular to the first direction;

an outer electrode including a plurality of outer conductor layers that, when viewed in the stacking direction, extends along the first direction and the second direction from the first point, the outer conductor layers being exposed from the multilayer body;

an inductor having a substantially helical configuration where a central axis extends in the stacking direction, the inductor including a plurality of inductor conductor layers disposed on the different insulator layers each other; and a lead conductor layer that connects one of the outer conductor layers with one of the inductor conductor layers, wherein each of the outer conductor layers has a first portion located farthest from the first point along the first direction in an uninterruptedly extending part of the outer conductor layer from the first point along the first direction, wherein the first portion has a second point located farthest from the first point along the second direction, wherein each of the outer conductor layers has a second portion located farthest from the first point along the second direction in an uninterruptedly extending part of the outer conductor layer from the first point along the second direction, wherein the second portion has a third point located farthest from the first point along the first direction, wherein the outer conductor layers include a first outer conductor layer, and wherein the first outer conductor layer has a protrusion different from the lead conductor layer, the protrusion protruding in a direction towards a center of the inductor from a corner of the first outer conductor layer in plan view when viewed in the stacking direction.

16. The electronic component according to claim 15, wherein the protrusion is located only inside a first region of a substantially triangular shape having a third side, a fourth side, and a fifth side, the third side connecting the second point with the third point, the fourth side extending from the second point in a reverse direction of the first direction, the fifth side extending from the third point in a reverse direction of the second direction.

17. The electronic component according to claim 15, wherein the protrusion has a first edge positioned between the first point and the second point and extending in the second direction and a second edge positioned between the first point and the third point and extending in the first direction.

18. The electronic component according to claim 17, wherein the first and second edges meet at a corner of the protrusion which is opposite to the corner of the first outer conductor layer.

19. The electronic component according to claim 18, wherein an end of the first edge opposite to the corner is at the fourth side and an end of the second edge opposite to the corner is at the fifth side.

20. The electronic component according to claim 15, wherein the outer electrode further includes an interlayer connection conductor, the interlayer connection conductor extending through one of the insulator layers in the stacking direction and connecting two of the outer conductor layers.

21. The electronic component according to claim 20, wherein the outer conductor layer includes a plurality of the first outer conductor layers, and wherein the fixing portions of the first outer conductor layers are connected by the interlayer connection conductor each other.

* * * * *